US008963714B2

(12) United States Patent
Medhal et al.

(10) Patent No.: US 8,963,714 B2
(45) Date of Patent: Feb. 24, 2015

(54) TAMPER-EVIDENT PACKAGING

(75) Inventors: Bhimaprasad Medhal, Lake Forest, IL (US); Guy C. Upchurch, Chicago, IL (US); Catherine A. Frank, Chicago, IL (US); James Lavery, Gurnee, IL (US); Matthew L. Phillips, Litchfield, CT (US); Philip Nathan, Royal Oak, MI (US); Robert H. Bruno, Avon, CT (US)

(73) Assignee: AbbVie Inc., North Chicago, IL (US)

( * ) Notice: Subject to any disclaimer, the term of this patent is extended or adjusted under 35 U.S.C. 154(b) by 0 days.

(21) Appl. No.: 13/531,185

(22) Filed: Jun. 22, 2012

(65) Prior Publication Data

US 2013/0126379 A1 May 23, 2013

Related U.S. Application Data

(60) Provisional application No. 61/500,944, filed on Jun. 24, 2011.

(51) Int. Cl.

| | |
|---|---|
| ***G08B 13/14*** | (2006.01) |
| ***B65D 79/00*** | (2006.01) |
| ***A61J 7/00*** | (2006.01) |

(Continued)

(52) U.S. Cl.

CPC ..... *B65D 79/00* (2013.01); *B65D 83/0409* (2013.01); *A61J 7/0069* (2013.01); *B65D 55/14* (2013.01); *B65D 83/0463* (2013.01); *B65D 2101/00* (2013.01); *B65D 2203/12* (2013.01); *B65D 2215/04* (2013.01); *G08B 13/22* (2013.01); *A61J 1/035* (2013.01); *A61J 7/0472* (2013.01); *A61J 2007/0436* (2013.01); *G08B 13/149* (2013.01)

USPC ..... 340/568.1; 340/541

(58) Field of Classification Search

CPC ..... G08B 13/149; B65D 83/00; B65D 83/04; B65D 83/0463; B65D 83/0409; A61J 1/035

USPC ..... 340/568.1, 541

See application file for complete search history.

(56) References Cited

U.S. PATENT DOCUMENTS

| | | | | |
|---|---|---|---|---|
| 4,717,042 | A | 1/1988 | McLaughlin | |
| 2004/0262189 | A1 * | 12/2004 | Fraser et al. | 206/536 |
| 2011/0295416 | A1 * | 12/2011 | Aquilonius et al. | 700/232 |

FOREIGN PATENT DOCUMENTS

| | | | |
|---|---|---|---|
| GB | 2465764 | A | 6/2010 |
| WO | 03022706 | A1 | 3/2003 |
| WO | 2008064428 | A1 | 6/2008 |

OTHER PUBLICATIONS

International Search Report and Written Opinion for Application No. PCT/US2012/043835, mailed on Jan. 21, 2013, 16 pages.

*Primary Examiner* — John A Tweel, Jr.

(74) *Attorney, Agent, or Firm* — Lisa V. Mueller; Michael Best & Friedrich LLP

(57) ABSTRACT

A tamper-evident package for pharmaceuticals is described. The package includes a case. A tray holding pharmaceuticals slides in and out of the case. The package includes an alarm that can be set to armed and triggered mode. When the alarm is armed, the system of the package changes the alarm to triggered in response to the tray being opened. The package may engage an access indicator in response to the alarm being triggered. The package may also flash an indicator light upon request, prior to opening the tray, to indicate whether the alarm was triggered since being previously armed. The alarm can be armed again if it is triggered, by entering a security code while the tray is closed.

15 Claims, 22 Drawing Sheets

(51) Int. Cl.

| | | | |
|---|---|---|---|
| ***B65D 55/14*** | (2006.01) | ***A61J 7/04*** | (2006.01) |
| ***G08B 13/22*** | (2006.01) | *B65D 83/04* | (2006.01) |
| | | *A61J 1/03* | (2006.01) |

| FIG. 28A | FIG. 28B | FIG. 28C | FIG. 28D |
|---|---|---|---|

TAMPER-EVIDENT PACKAGING

This application claims priority under 35 U.S.C. 119 (e) to U.S. Provisional Application No. 61/500,944 filed Jun. 24, 2011, the entire contents of which are incorporated herein by reference.

FIELD OF THE INVENTION

The present invention relates to tamper-evident packaging for pharmaceuticals.

SUMMARY OF THE INVENTION

The invention provides a tamper-evident package for pharmaceuticals, comprising: a case, comprising a key pad and one or more indicator lights; and a tray, wherein the tray is engaged to the case.

In some embodiments, the tray holds a blister sheet of pharmaceutical tablets; and wherein the case substantially conceals or encloses the blister sheet within the case when the tray is closed. In some embodiments, the blister sheet includes a first side and a second side, wherein the first side folds over on to the second side, and the tablets of the first side and the tablets of the second side are in an interweaving arrangement. In some embodiments, the case comprises a logic controller in electrical communication with the indicator lights and the key pad, wherein the tray slides in and out of a side opening of the case, and triggers a switch of the logic controller. In some embodiments, the case comprises a logic controller in electrical communication with the indicator lights and the key pad, wherein the key pad comprises a status key to check whether the tamper-evident package has been accessed without entering a security code. In some embodiments, the case comprises a logic controller in electrical communication with the indicator lights and the key pad, wherein the key pad comprises a status key to check, wherein the logic controller includes an alarm switchable between an armed state and a triggered state, wherein the logic controller flashes a first color indicator light in response to actuating the status key when the alarm is in the armed state and the logic controller flashes a second color indicator light in response to actuating the status key when the alarm is in the triggered state.

The invention also provides a method for managing the status of an alarm associated with a pharmaceutical package, the method comprising: (a) providing a pharmaceutical package having a logic controller with memory and a user action electronically communicating with the logic controller, the pharmaceutical package containing a pharmaceutical; (b) programming a security code into the memory; (c) entering the security code through the user action; (d) with the logic controller, automatically setting an alarm to a first status in response to the logic controller receiving the security code in step (c); and (e) after step (d), using the logic controller to automatically set the alarm to a second status, different from the first status, in response to the logic controller sensing access to the pharmaceutical in the container.

In some embodiments, step (b) includes programming the security code into the memory in a nonvolatile state in which the security code cannot be erased or overwritten. In some embodiments, step (a) includes providing a check key as part of the user input interface; and wherein step (c) includes pressing the check key after entering the security code. In some embodiments, step (a) includes providing a check key as part of the user action and providing a system response electronically communicating with the logic controller; the method further comprising: after step (c), pressing the check key; in response to pressing the check key after step (c), providing a first user feedback signal if the alarm is set to the first status and providing a second user feedback signal, different from the first user feedback signal, if the alarm is set to the second status. In some embodiments, the first user feedback signal includes at least one of a light, a sound, and a vibration detectable by a human. In some embodiments, step (a) includes providing a system response electronically communicating with the logic controller; the method further comprising using the logic controller to activate the system response for a predefined time immediately following the alarm being set to the second status. In some embodiments, the method further comprises the step of recording in the memory a time and date stamp of access. In some embodiments, step (a) includes providing the pharmaceutical container with a case and a tray able to slide at least partially into and out of the case, the tray carrying the pharmaceutical; and wherein access to the pharmaceutical in step (e) includes sliding the tray at least partially out of the case. In some embodiments, step (a) includes providing an access status switch in the pharmaceutical container; the method further comprising the step of detecting with the access status switch when the tray is not in a fully closed state; and disabling step (b) with the logic controller while the access status switch detects that the tray is in the not fully closed state. In some embodiments, step (b) includes programming a security code having any one of four, five, and six characters. In some embodiments, step (b) is accomplished manually by way of the user action. In some embodiments, step (a) includes providing a keypad on the pharmaceutical container as part of the user action; and wherein step (c) includes manually entering the security code by way of the keypad. In some embodiments, step (a) includes providing a child-resistant feature; the method further comprising the step of deterring access to the pharmaceutical in the container unless the child-resistant feature is defeated.

The invention also provides an access-evident package for an array of pharmaceuticals, the package comprising: a case adapted to receive the array in a closed position at least partially within the case, the array being movable into an open position for access to the pharmaceuticals; a logic controller mounted to the case, the logic controller including memory to receive and store a security code and also including an alarm having an armed state and a triggered state; and a user action electronically communicating with the logic controller and enabling a user to enter the security code to cause the logic controller to set the alarm to the armed state; wherein the logic controller switches the alarm to the triggered state in response to the array moving from the closed position to the open position.

In some embodiments, the user action includes a keypad for entering the security code. In some embodiments, the logic controller prevents entry of the security code while the array is at least partially removed from the case. In some embodiments, the access-evident package further comprises an access alert electronically communicating with the logic controller; wherein the logic controller activates the access alert in response to the alarm being in the triggered state. In some embodiments, the access-evident package further comprises an access alert electronically communicating with the logic controller; wherein the user action includes a check key; and wherein the logic controller activates the access alert in response to the alarm being in the triggered state and a user actuating the check key. In some embodiments, the access-evident package further comprises a latch preventing movement of the array from the fully closed position; and a slide lever movable into a disengaging position in which the slide lever disengages the latch to permit movement of the array from the closed position. In some embodiments, the slide lever is moved out of the disengaging position in response to moving the array into the fully closed position. In some embodiments, the access-evident package further comprises a tray adapted to carry the array, the tray being received within the case and adapted to slide at least partially in and out of the case to provide access the array. In some embodiments, the access-evident package further comprises engaging structures on each of the case and tray that engage each other to brake movement of the tray with respect to the case as the tray approaches a fully open position in which access is grated to the array of pharmaceuticals. In some embodiments, the access-evident package further comprises a biasing member acting on the array; wherein the biasing member is deflected upon movement of the array into the fully closed position, to generate a biasing force in the biasing member; wherein the biasing force biases the array toward an open position in which at least a portion of the array is removed from the case. In some embodiments, the access-evident package further comprises a child-resistant mechanism holding the array in the fully closed position against the biasing force; wherein actuation of the child-resistant mechanism releases the array to enable the biasing member to move the array toward the open position under the influence of the biasing force.

DETAILED DESCRIPTION OF INVENTION

The tamper-evident or access-evident package will now be described with reference to the FIGS. The terms tamper-evident and access-evident are used synonymously in this specification. The terms "tamper" and "access" are both intended to mean actual or attempted access without regard to the intent behind such access. A tamper-evident package 10 to hold or store pharmaceuticals is shown in FIGS. 1-10.

Figure 1:
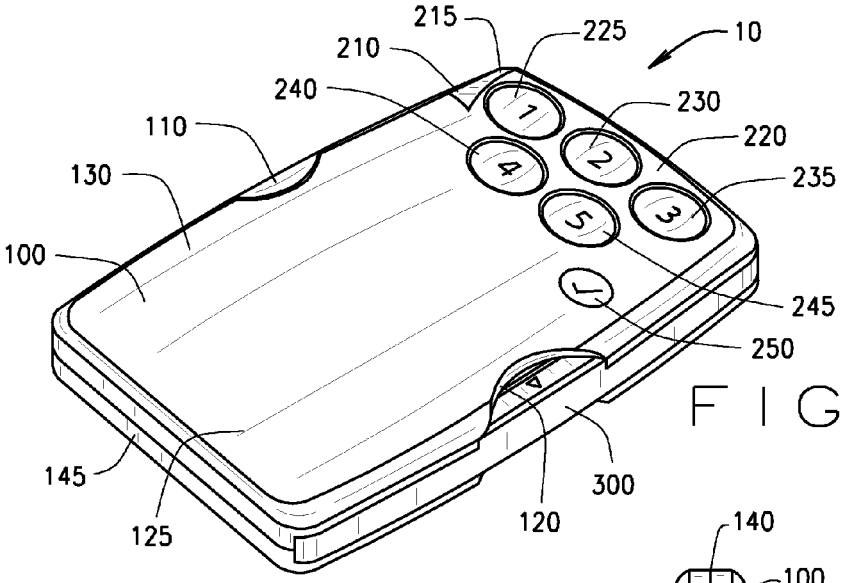
FIG. 1 is a perspective view of the tamper-evident packaging.
Figure 2:
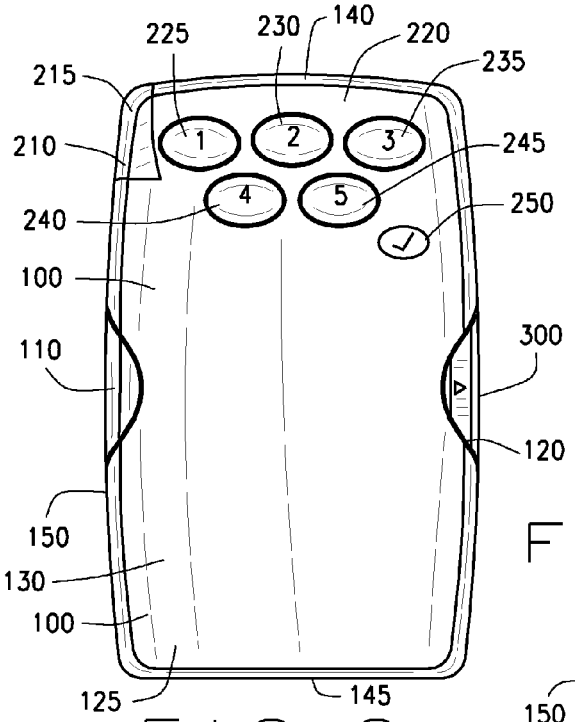
FIG. 2 is a top view of the tamper-evident packaging.
Figure 3:
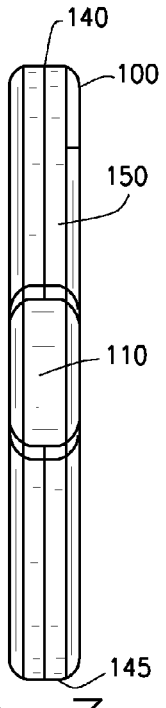
FIG. 3 is a first side view of the tamper-evident packaging.
Figure 4:
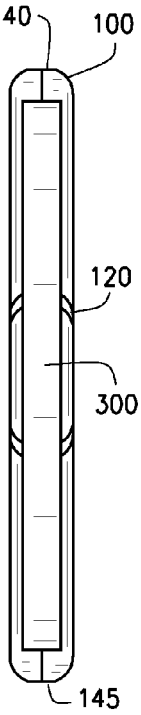
FIG. 4 is a second side view of the tamper-evident packaging.
Figure 5:
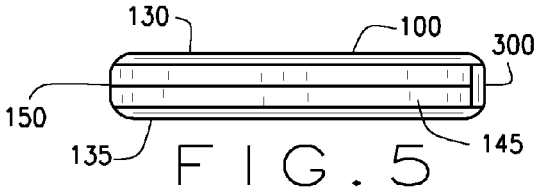
FIG. 5 is an end view of the tamper-evident packaging.
Figure 8:
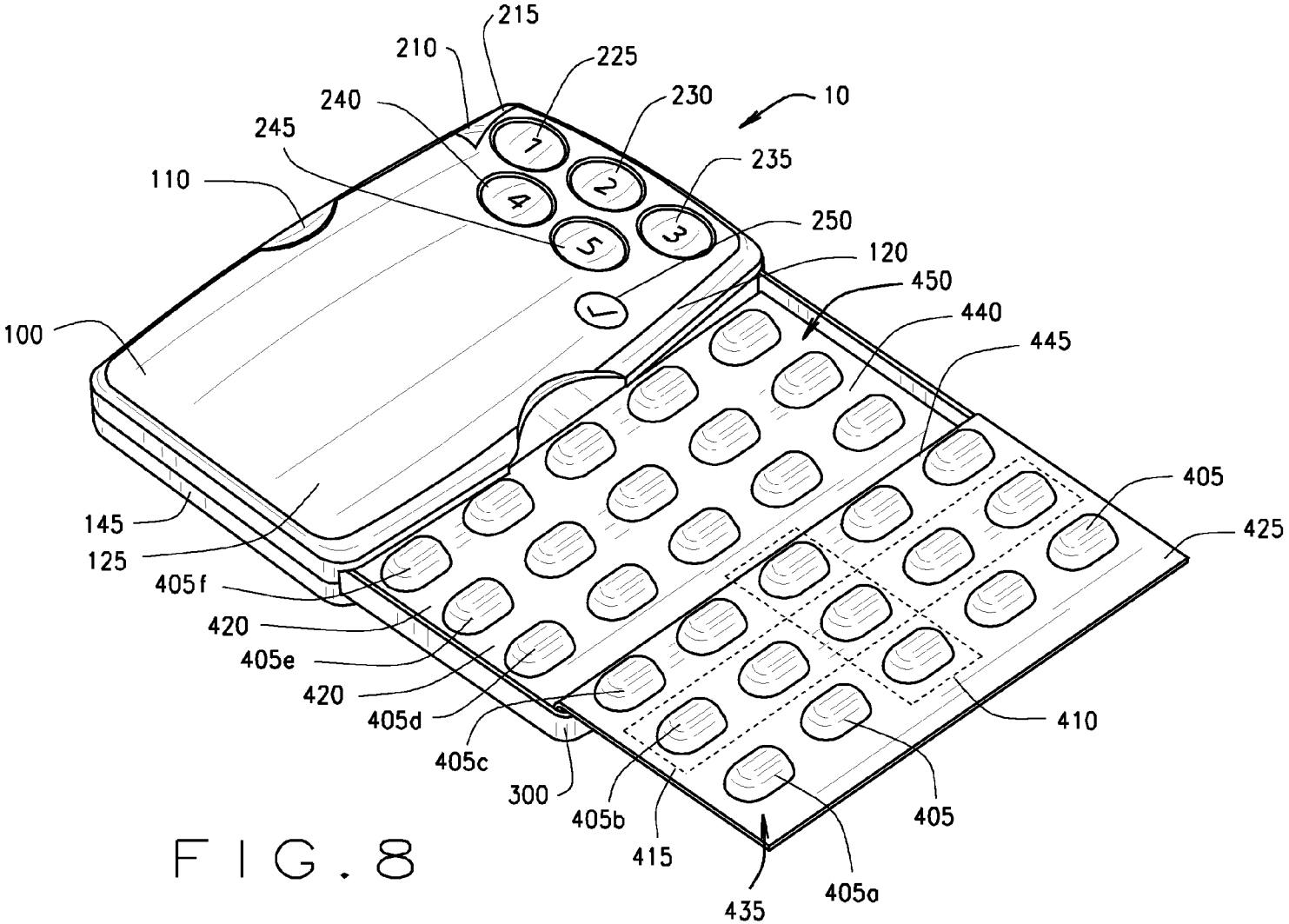
FIG. 8 is a view of the tamper-evident packaging with the tray opened.

A perspective view of the tamper-evident package 10 is shown in FIG. 1. The tamper-evident package 10 includes a case 100 and a tray 300. As shown in FIG. 8, the tray 300 slides in and out of the case 100. The tray 300 holds or contains a blister sheet 400 of pharmaceuticals (shown in FIG. 6), such as tablets 405. The tray 300 slides in and out of an interior 105 of the case 100. With reference to FIGS. 1 and 2, the case 100 includes an exterior surface 125 with a cutout 120. The cutout 120 provides the user with an access point to grasp the tray 300 in order to pull the tray 300 from the case 100.

Figure 6:
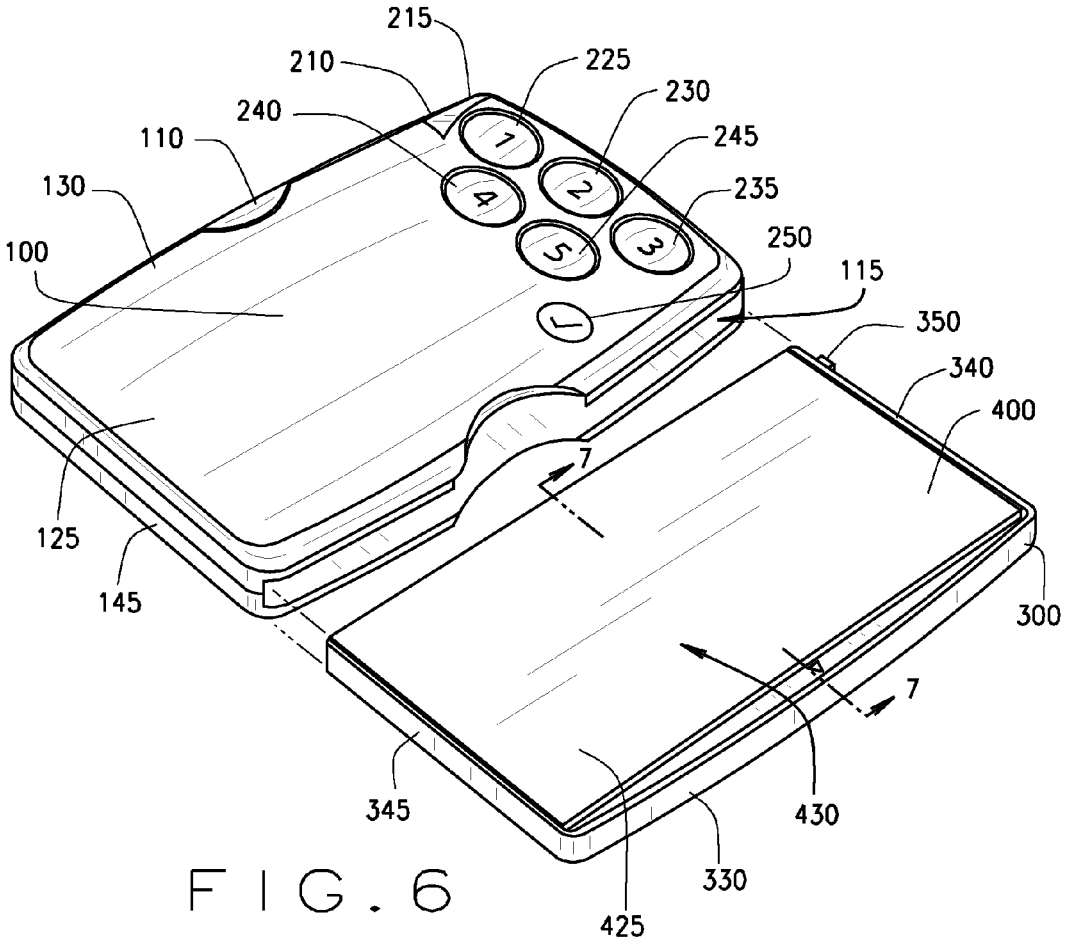
FIG. 6 is an exploded view of the tamper-evident packaging.

The tray 300 slides from the case 100 and generally remains attached to the case 100. As such, the tray 300 is slideably engaged to the case 100. FIG. 6 shows an exploded view of the package 10, with the tray 300 disassembled from the case 100. The tray 300 slides in and out of a side opening 115 of the case 100. The side opening 115 is shown in FIG. 6.

Figure 10:
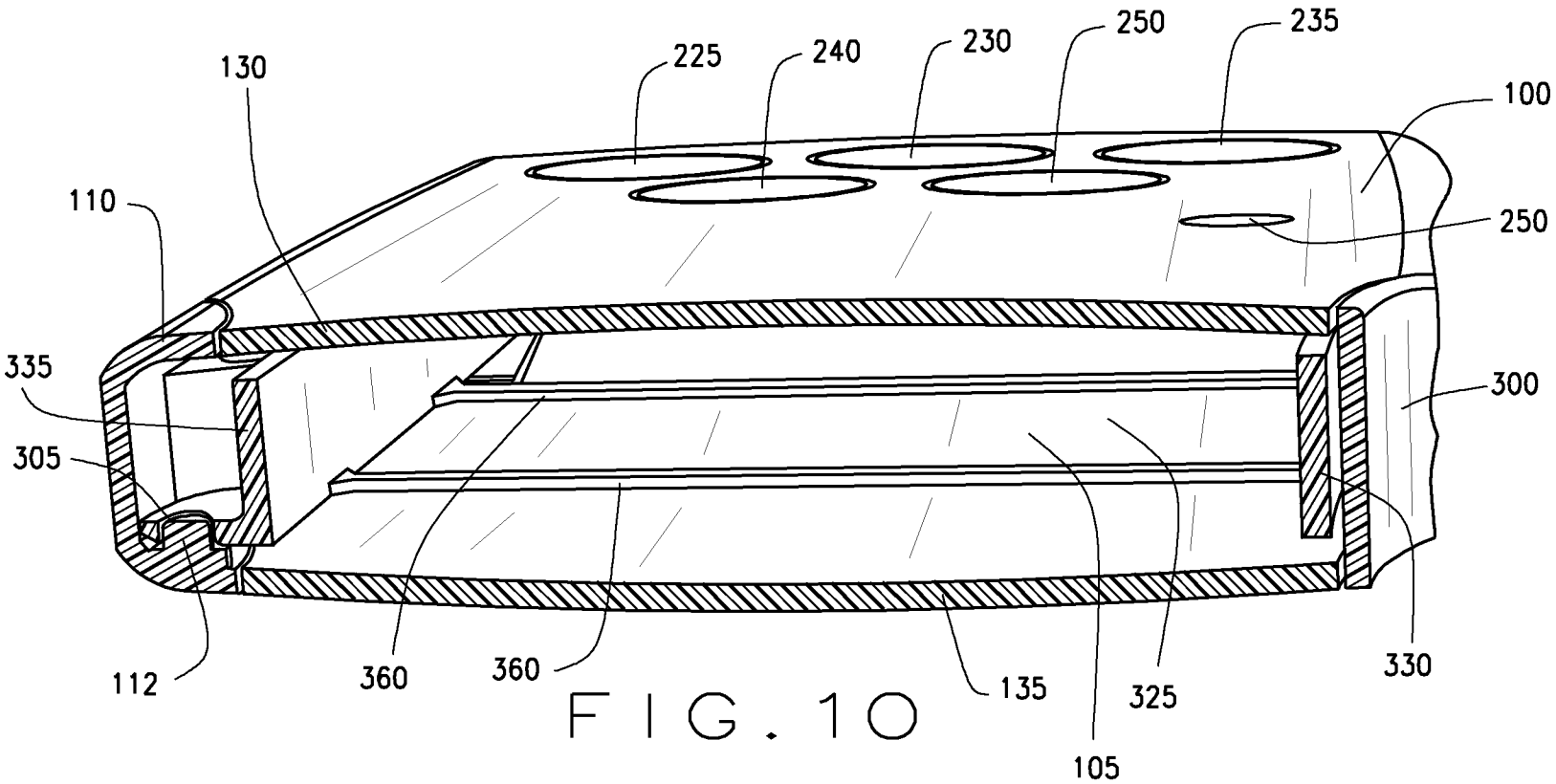
FIG. 10 is a sectional view of the tamper-evident packaging.

The case 100 includes a release tab 110 that provides a child safety feature. In order to open the tray 300 from the case 100, the release tab 110 must be pressed. The release tab 110 presses on a tray release assembly 305 of the tray 300 in order to release the tray 300 from the case 100. With reference to FIG. 10, the release tab 110 is integral or attached to a release tab latch 112, which engages with the tray release assembly 305. When the release tab 110 is pressed down, the release tab latch 112 is lowered and unlatched from the tray release assembly 305 to allow the tray 300 to slide from the case 100. Although the release tab 110 is illustrated, the case 100 may be equipped with any of a variety of child safety features.

With reference to FIG. 2, the case 100 has a generally rectangular or box shape. The case 100 may be made from a durable or rigid molded plastic. For example, the case 100 may be molded from thermal plastics. The case 100 defines the interior 105, which is generally hollow to receive the tray 300. The case 100 includes an upper wall 130 opposite of a lower wall 135. The case further includes a first end wall 140 opposite of a second end wall 145. The case 100 further includes a side wall 150 opposite of the side opening 115. The case 100 includes the exterior surface 125 that may include prescription information, product information, ornamentation, branding, etc.

Figure 9:
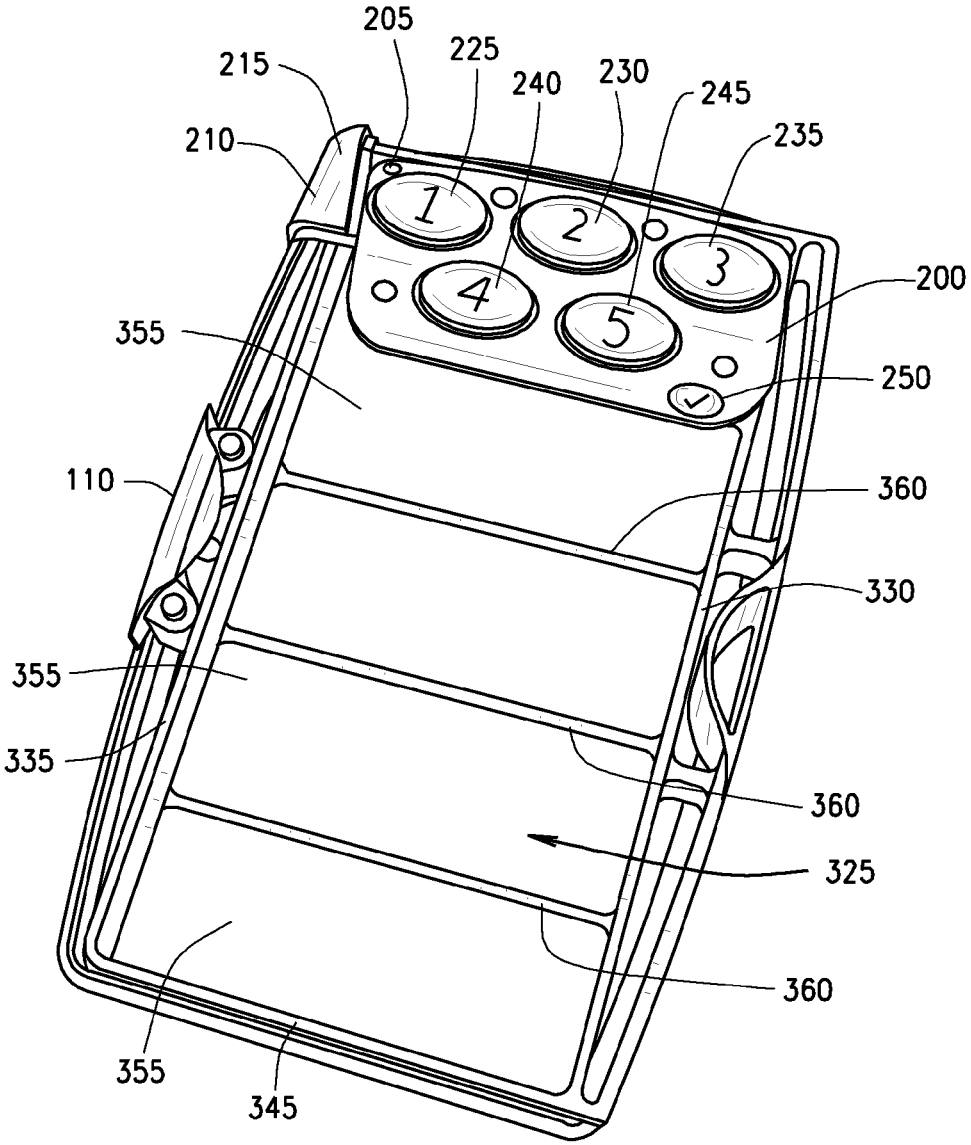
FIG. 9 is a view of the tamper-evident packaging with a portion of the case removed.

With reference to FIG. 9, the case 100 further includes a logic controller 200. The logic controller 200 may be printed and/or formed on a circuit board. The logic controller 200 may be integrated or molded to the case 100. The logic controller 200 controls and directs the tamper-evident package 10. The logic controller 200 includes a memory to receive and store the security code. The logic controller 200 directs the security system for monitoring access to the package 10. The logic controller 200 is in electrical communication with a key pad 220, a switch 205, a red light 210, and a green light 215. The key pad 220 may be mounted on or into the exterior surface 125 of the case 100.

The memory stores the security data, which includes at least one valid security code. The key pad 220 generates an authentication request in response to user input from the key pad 220. The authentication request includes a particular code input by the user. The logic controller 200 determines if the authentication request has been generated and compares the particular code included in the authentication request generated at the key pad 220 to the security code stored in the memory. The logic controller 200 deactivates the flashing of the red light 210 if the particular code matches the at least one valid security code. The logic controller 200 activates the flashing of the green light 215 if the particular code matches the at least one valid security code.

The red light 210 generally signifies that unauthorized access to the tray 300 has occurred, while the green light 215 generally signifies that no unauthorized access to the tray 300 has occurred. The tray 300 includes a switch actuator 350 that actuates the switch 205 of the logic controller 200. When the tray 300 is pulled from the interior 105 of the case 100, the switch actuator 350 (shown in FIG. 6) switches or triggers the switch 205.

The switch 205 and the switch actuator 350 may be any of a variety of switch or trigger mechanisms. For example, the switch actuator 350 may be a mechanical protrusion that presses a trigger or button of the switch 205. For example, the switch 205 and the switch actuator 350 may be replaced with electrical contacts that open and close as the tray 300 moves to its open and closed positions. For example, the switch actuator 350 may be omitted and the switch 205 triggers as the tray 300 is removed, i.e., the movement of the tray 300 physically uncovers the switch 205, which is biased, causing the switch 205 to trigger.

The key pad 220 includes two or more keys to provide for users to enter a security code into the tamper-evident package 10. With reference to FIG. 2, the key pad 220 includes a first key 225, a second key 230, a third key 235, a fourth key 240, a fifth key 245, and a status key 250. Additional keys may be utilized with the tamper-evident package 10. Each of the keys may include an alphabetical, numerical, or other symbol for use in entering the security code into the tamper-evident package 10. As shown in FIG. 2, the first key 225 includes the number 1, the second key 230 includes the number 2, the third key 235 includes the number 3, the fourth key 240 includes the number 4, and the fifth key 245 includes the number 5.

The security code may include a sequence of entries into the key pad 220. For example, the security code may include four entries on the key pad 220. The security code may be chosen by the user to provide a personal identification number.

The status key 250 may be used to check the status of the tamper-evident package 10. For example, the user may press the status key 250 to see if the tamper-evident package 10 has been accessed without entering the security code. If an unauthorized use has been detected by the tamper-evident package 10, then the red light 210 will flash red upon the user pressing the status key 250. Likewise, the green light 215 will flash green when the user presses the status key 250 when no unauthorized access has been detected by the tamper-evident package 10.

The logic controller 200 further includes a battery to power the tamper-evident package 10. The battery may include any of the variety of batteries commercially available to power the electrical components herein described. The lights 210 and 215 may include commercially available light emitting diodes.

The tray 300 will now be described with reference to FIGS. 9 and 10. The tray 300 includes the tray release assembly 305 that allows the tray 300 to be opened from the case 100. The tray 300 further defines an interior 325 that holds or contains the blister sheet 400. The tray 300 includes a first side wall 330 opposite of a second side wall 335. The tray 300 includes a first end wall 340 opposite of a second end wall 345. The tray 300 provides a shallow holding structure.

The tray 300 further includes one or more openings 355 that are partially defined by supports 360, which extend a width of the tray 300. The supports 360 support the blister sheet 400. The openings 355 allow the user to press on top of the tablets 405 of the blister sheet 400 and the tablets 405 press pass through the openings 355 of the tray 300.

The blister sheet 400 will now be described with reference to FIGS. 7 and 8. The blister sheet 400 may be divided into a first side 425 and a second side 440, and each side 425 and 440 include a plurality of the tablets 405. The first side 425 may fold over and onto the second side 440. With reference to FIG. 6, the first side 425 is on top of the second side 440.

The blister sheet 400 includes one or more rows 410 of the tablets 405 along with one or more columns 415 of the tablets 405. The embodiment of the FIGS. includes the rows 410 having three tablets 405 and the columns 415 having five tablets 405. Thus, each of the first side 425 and the second side 440 includes fifteen tablets 405 (or thirty in total), which is the amount provided in a typical prescription. Depending upon the pharmaceutical and its dosage, the tablets 405 may be increased or reduced in size or number to include more than or less than thirty tablets 405.

The blister sheet 400 may be divided into the first side 425 and the second side 440. A dividing line 445 (shown in FIG. 8) may be positioned between the first side 425 and the second side 440. The dividing line 445 may include a crease, a bend, a perforation, or cut score in the blister sheet 400 that promotes the folding or bending of the first side 425 on to the second side 440. When the tray 300 is pulled from the case 100, the first side 425 is plainly visible. The first side 425 may be opened, like a book, to reveal the second side 440.

The first side 425 includes a top surface 430 and a bottom surface 435. In the closed position, the bottom surface 435 is over the second side 440. The second side 440 includes a top surface 450 and a bottom surface 455. The second side 440 further includes an inner edge 460 that is attached to the tray 300 via adhesives, welding, etc. When the first side 425 is folded over on to the second side 440, the tablets 405 of the first side 425 and the tablets 405 of the second side 440 are in an interweaving arrangement that facilitates efficient use of the space of the interior 325 of the tray 300 and helps to minimize the overall size of the case 100.

Figure 7:
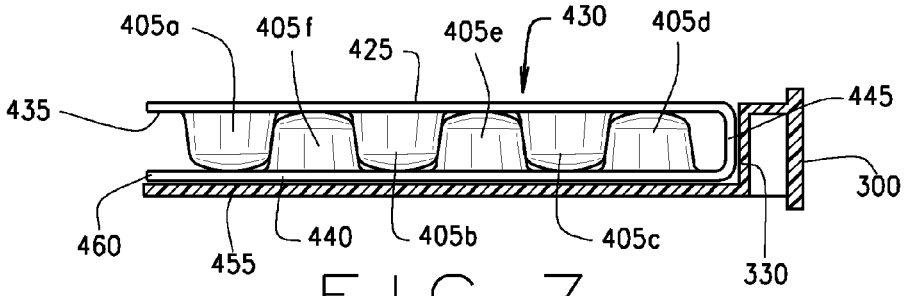
FIG. 7 is a sectional view of the tamper-evident packaging.

As shown in FIGS. 7 and 8, the tablets 405 on the first side 425 are positioned in spaces 420 next to the tablets 405 of the second side 440. For example, a tablet 405*a* on the first side 420 is positioned in the space 420 next to a tablet 405*f* on the second side 440 when the first side 420 is folded over on to the second side 440. For example, a tablet 405*b* on the first side 420 is positioned in the space 420 between the tablet 405*f* and a tablet 405*e* on the second side 440 when the first side 420 is folded over on to the second side 440. For example, a tablet 405*c* on the first side 420 is positioned in the space 420 between the tablet 405*e* and a tablet 405*d* on the second side 440 when the first side 420 is folded over on to the second side 440.

Various modes and methods of operation of the security system of the package 10 will now be described. The time intervals and flashing sequences described herein are exemplary and may be modified for a particular application or use of the package 10. The security system flashes the red light 215 if the tray 300 has been accessed without entering the security code into the key pad 220.

First, the operation of the package 10 will be described when the packaging 10 has been stored with the correct security code having been successfully entered into the packaging 10.

If the user picks up the package 10 and presses the status key 250, then the green light 215 will flash three times. This indicates that the package 10 is in a safe mode, which indicates that no tampering or unauthorized access has occurred.

If the user picks up the package 10 and opens the tray 300 without again entering the security code, an alarm mode is entered, and the red light 210 starts flashing slowly for approximately two minutes, and then the red light 210 slows to flash one time per ten seconds for approximately six hours. The prolonged flashing of the red light 210 may alert the owner that tampering to the package 10 has occurred. Finally, the package 10 goes to a sleep mode to conserve the battery of the package 10.

However, the user may close the tray 300 and enter the correct security code to stop the red light 210 from continuing to flash. When the correct security code has been entered, the green light 215 flashes three times, and the package 10 returns to the safe mode.

If the user picks up the package 10 and enters the correct security code, the green light 215 flashes three times in a rapid manner. The user may then open the tray 300, remove the tablets 405, and close the tray 300. After approximately two minutes of the tray 300 being closed, any further access of the tray 300 will revert to the alarm mode, and a subsequent opening of the tray 300 without prior entry of correct code will result in the red light 210 flashing as described above.

Second, the operation of the package 10 will be described when the packaging 10 has been stored after unauthorized access.

If the user picks up the package 10 and presses the status key 250, then the red light 210 flashes three times. This indicates the alarm mode in which the package 10 has been tampered with, since someone opened the tray 300 without properly entering the security code.

If the user picks up the package 10 and opens the tray 300, then the red light 210 starts flashing slowly for approximately two minutes, then slows to flash one time per ten seconds for six hours. Finally, the package 10 goes to the sleep mode to conserve the battery. However, the user may close the tray 300 and enter the correct security code, which will cause the green light 215 to flash three times and go to the safe mode.

If the user picks up the package 10 and properly enters the security code, the green light 215 flashes three times. The user may then open the tray 300, take the tablets 405, and close the tray 300. After two minutes of the tray 300 being closed, any further access of the tray 300 will revert to the alarm mode and a subsequent opening of the tray 300 without prior entry of correct code will result in the red light 210 flashing.

Third, the operation of the package 10 will be described after unauthorized access has occurred.

If the user picks up the package 10 and opens the tray 300, the red light 210 starts flashing slowly for two minutes to indicate the alarm mode, then slows to flash one time per ten seconds for six hours, and then goes to sleep.

If the user picks up the package 10 and enters the wrong security code, then there will be no response from the package 10. The security system only responds with three flashes of the green light 215 for the entry of the correct security code or a flashing of the red light 210 for opening of drawer 310 without prior entry of the security code.

Fourth, the first time use of the package 10 will now be described. The user presses the status key 250. The green light 215 turns on solid until the user enters the first key of a four key security code. After the first key is entered, the green light 215 flashes. The user then enters the remaining three keys of the security code. The green light 215 flashes once for each key entry. After the fourth key is entered, the green light 215 turns on solid again. The user may, optionally, repeat and/or change the code at this time. The user presses the status key 250 one more time. The green light 215 flashes green three times and goes off. The package 10 is programmed and safe.

Generally, the package 10 may not be reprogrammed after the initial security code has been accepted. This helps reduce any risk of an authorized user reprogramming the package 10 to avoid detection In other aspects, the package 10 is assigned the security code at the manufacturing facility or pharmaceutical packager. The security code may be provided with the package as received from the pharmacy or other pharmaceutical distributor.

In other aspects, one or more audible alarms may be used in conjunction with or instead of the flashing of the green light 215 and the flashing of the red light 210.

In other aspects, the green light 215 and the flashing of the red light 210 may be replaced with a single light of a single color that flashes in different manners and routines to provide the various signals described herein. For example, the single light could flash in a rapid pattern similar to the green light 215, and the single light could flash in a slower pattern to resemble the red light 210.

FIGS. 11-22 illustrate another construction of an access-evident package 500 for an array of pharmaceuticals 505. The package 500 includes a case 510, a tray 515, a child-resistant feature 520, a logic controller assembly 525, a user action 530, and an access alert 535.

"Access-evident" means a system that evinces whether access has been attempted or made, without regard to whether such access was authorized or for legitimate purposes or for the purpose of tampering or any other purpose. For the purposes of this specification, the term "access" means actual or attempted access to the pharmaceuticals, as evidenced by opening the tray or actuating a child-resistant feature. The term does not necessarily include tearing or otherwise breaching the foil backing of a blister pack or other packaging, as regulations and standards might require for "access" to be achieved. The term "child-resistant feature," as used herein, refers to a feature used in a child-resistant package pursuant to the Poison Prevention Packaging Act of 1970, 16 CFR, Part 1700 as amended from time to time.

Figure 25:
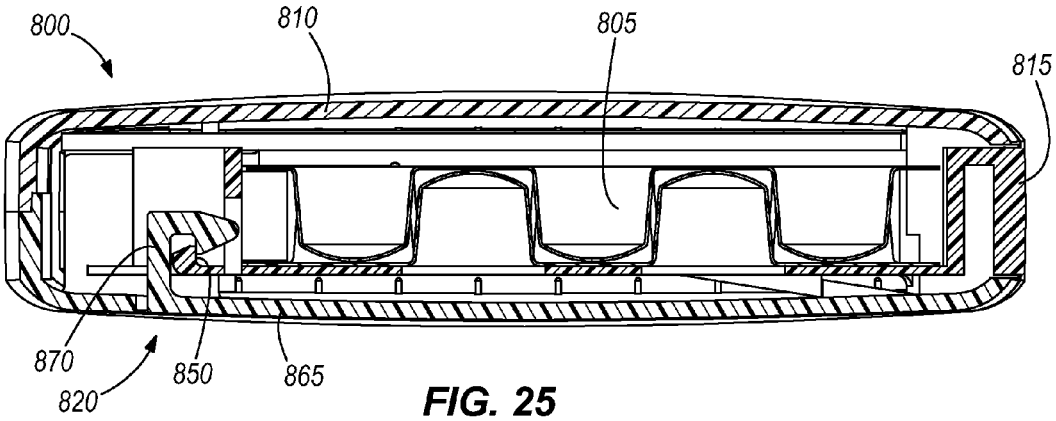
FIG. 25 is a cross-sectional view along line 25-25 in FIG. 23.
Figure 26:
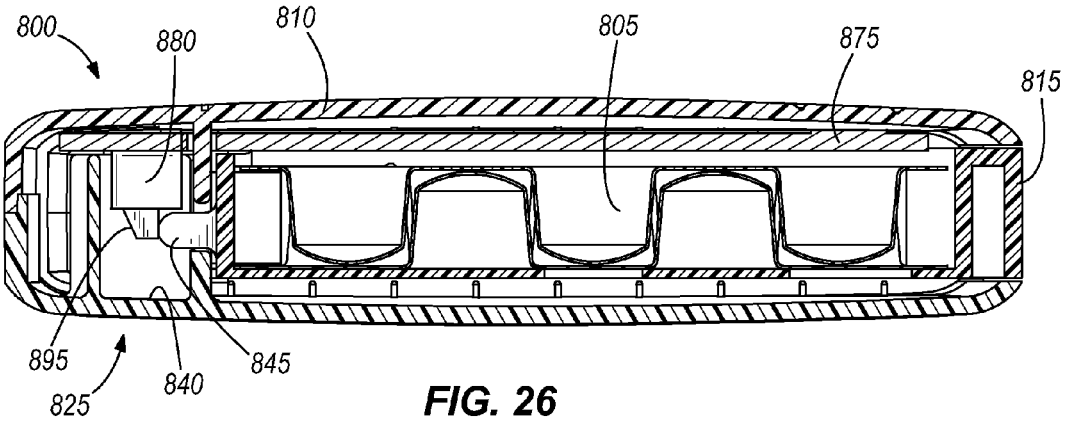
FIG. 26 is a cross-sectional view along line 26-26 in FIG. 23.
Figure 27:
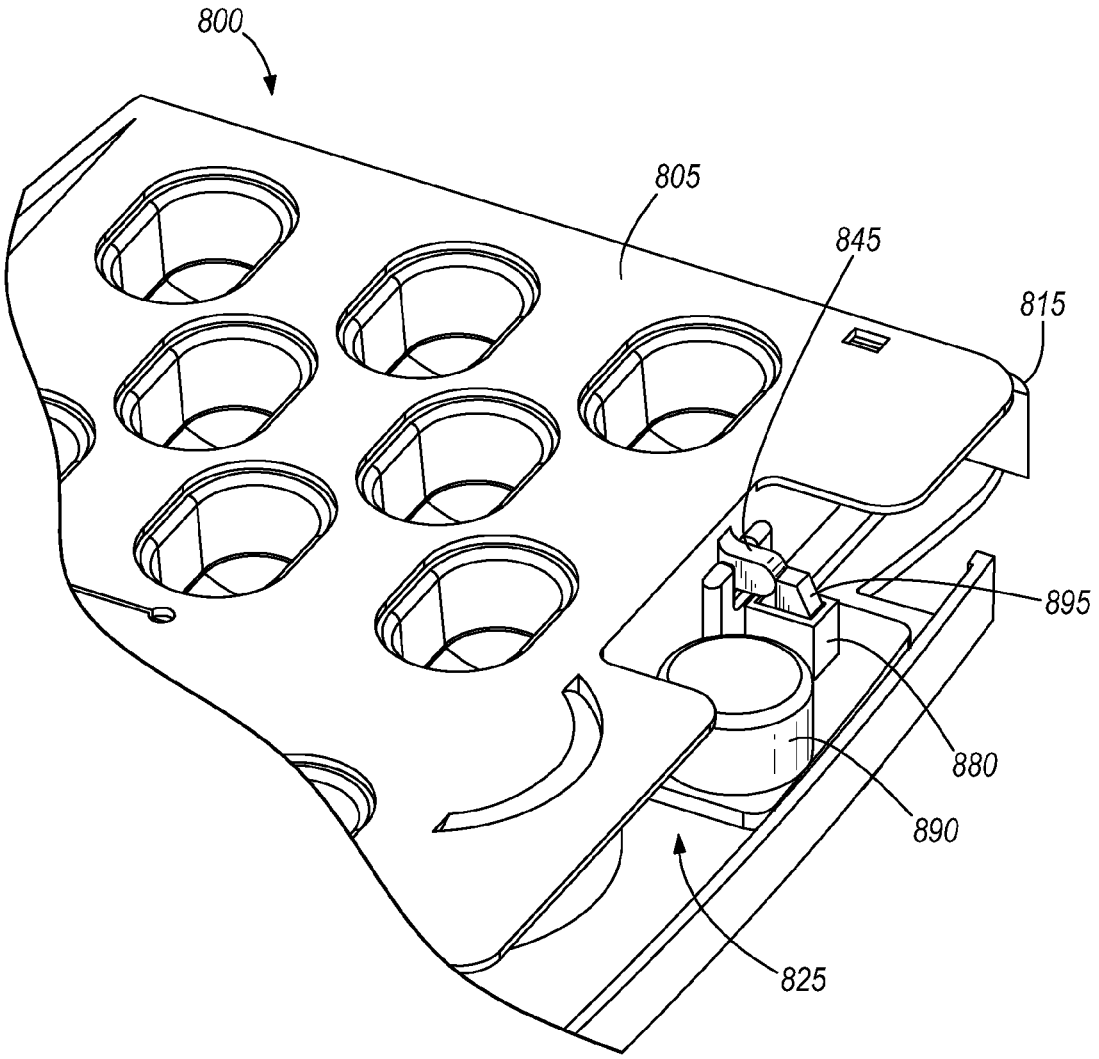
FIG. 27 is a perspective view of a portion of the construction of FIG. 23.
Figure 28A:
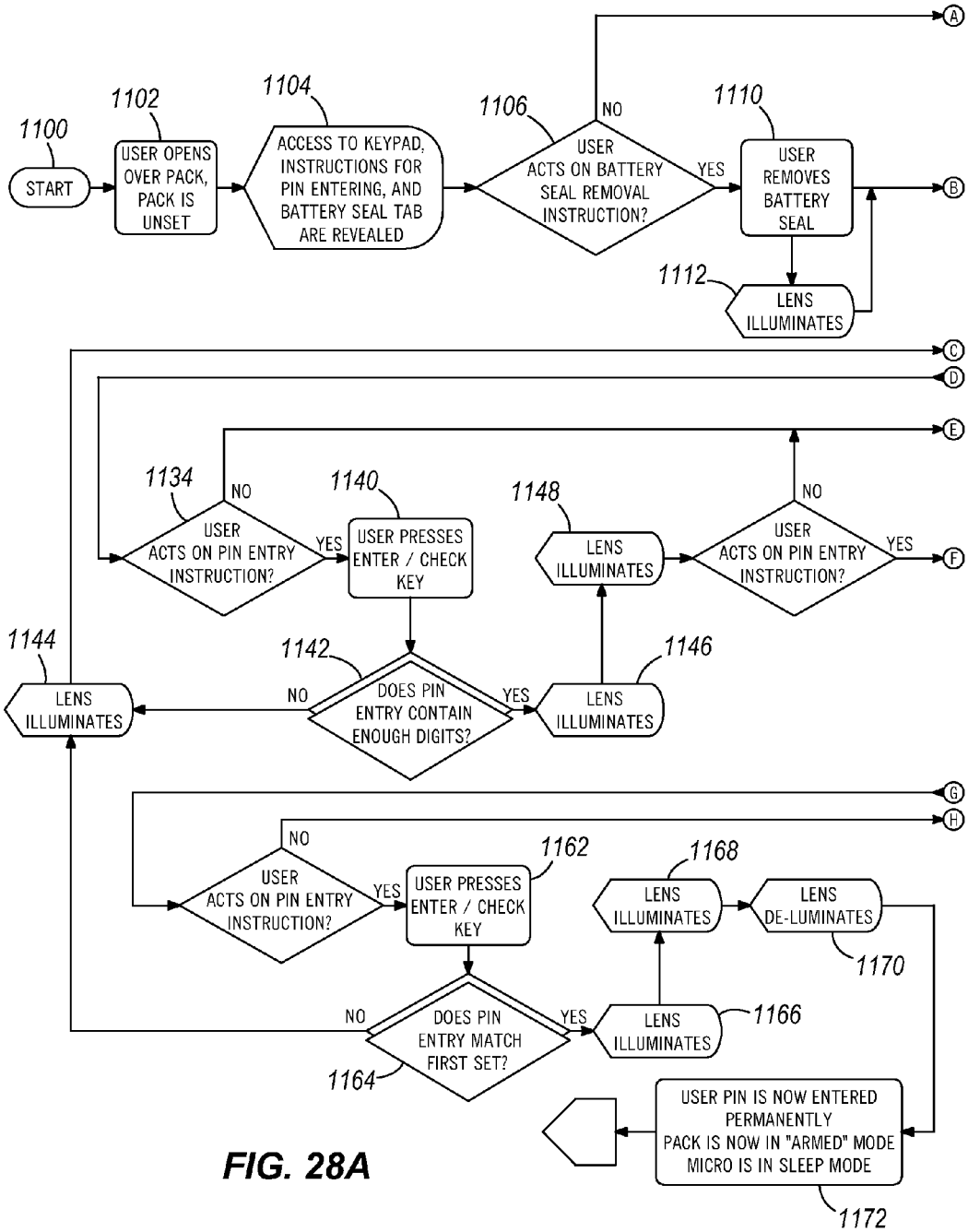
FIG. 28A is a first portion of a logic flow chart for entering a security code into memory in the access-evident packaging.
Figure 28B:
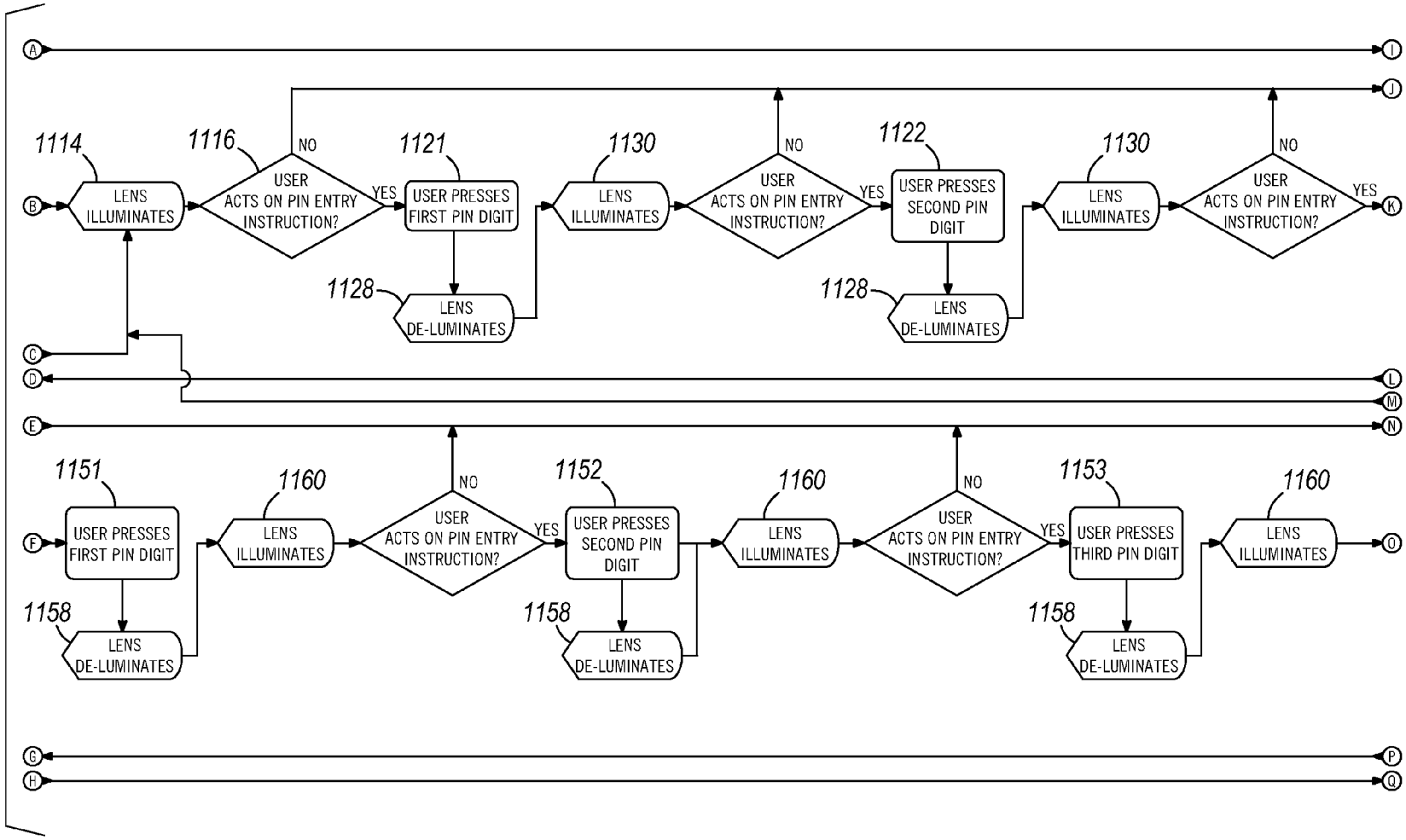
FIG. 28B is a second portion of a logic flow chart for entering a security code into memory in the access-evident packaging.
Figure 28C:
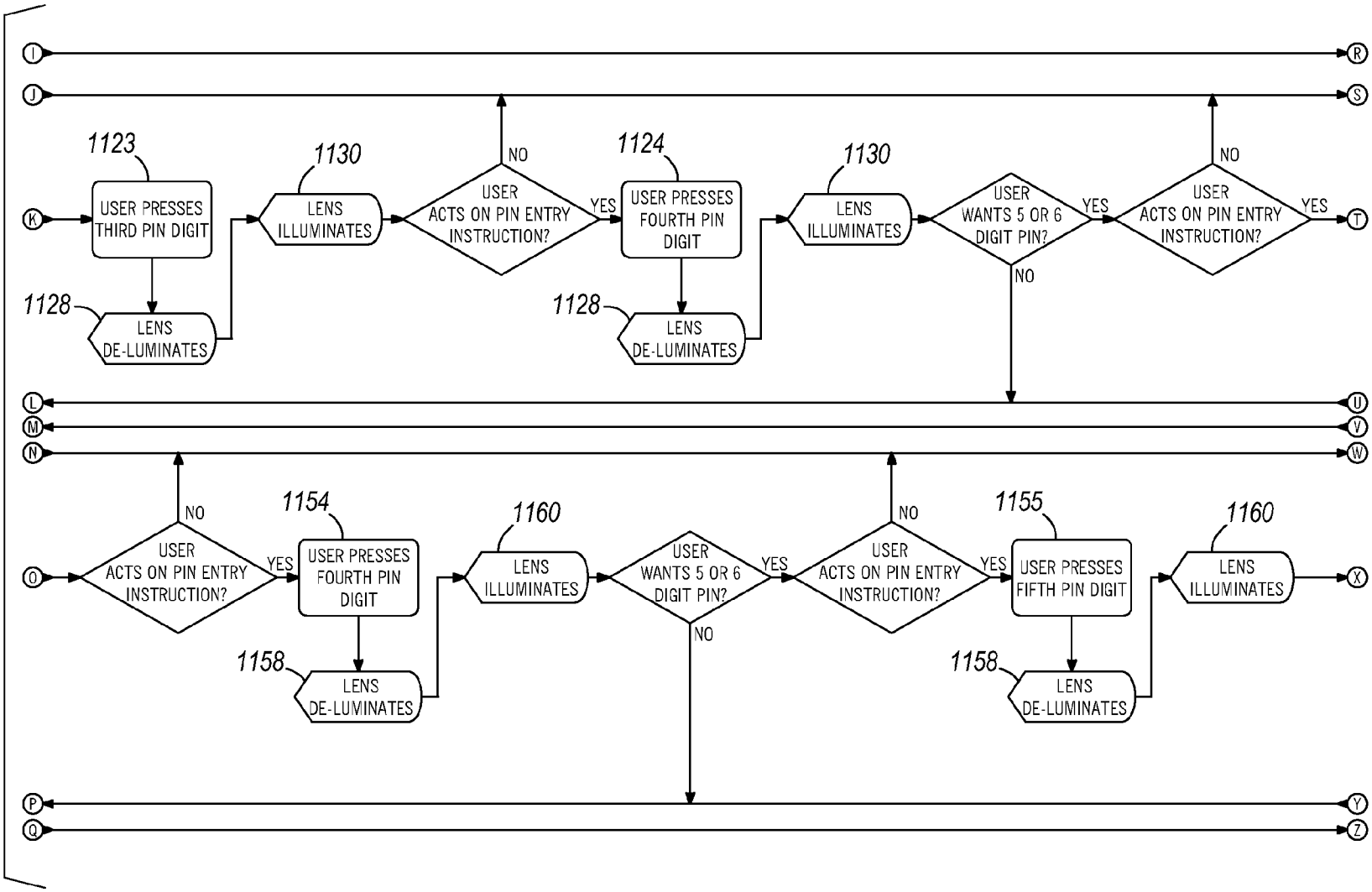
FIG. 28C is a third portion of a logic flow chart for entering a security code into memory in the access-evident packaging.
Figure 28D:
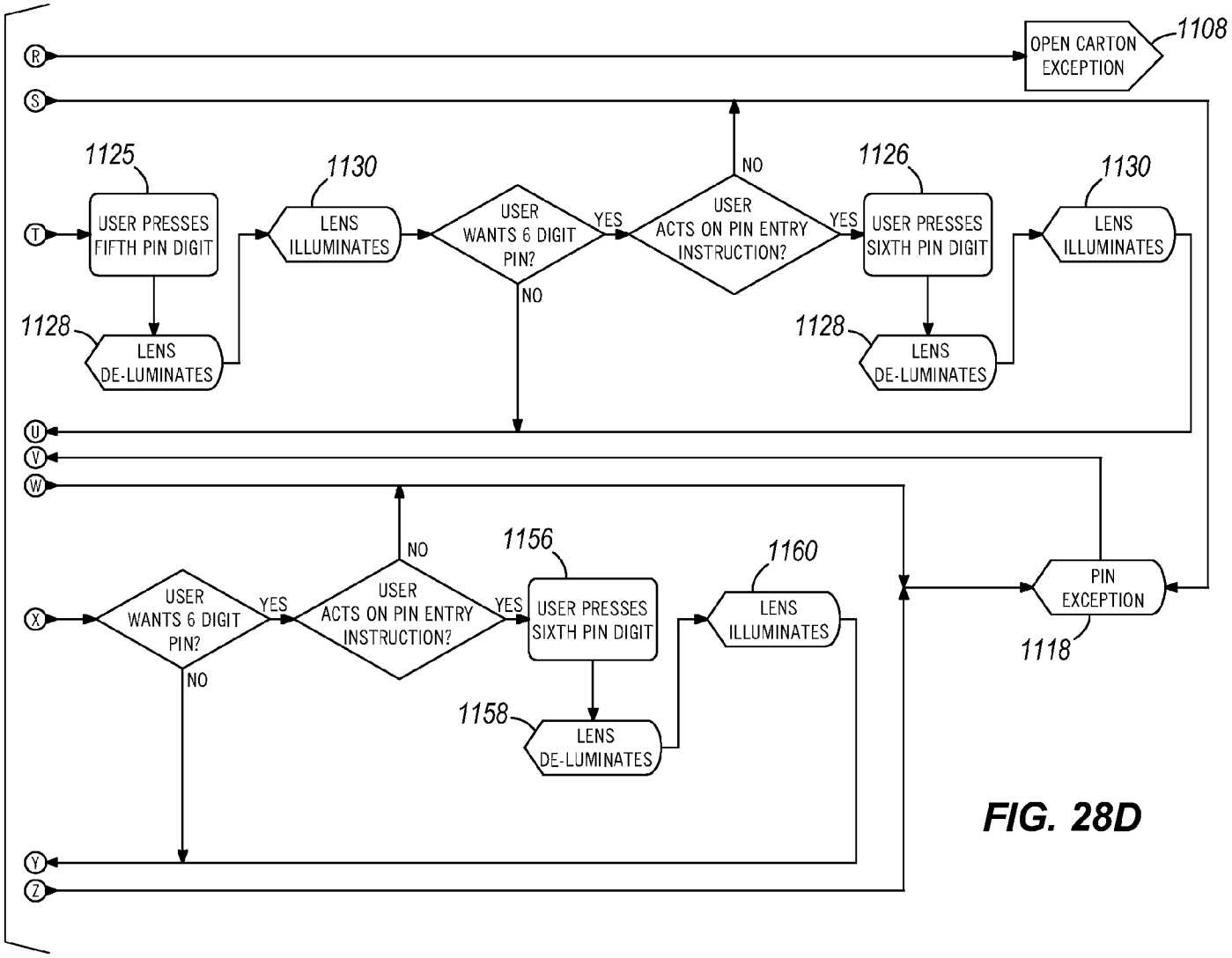
FIG. 28D is a fourth portion of a logic flow chart for entering a security code into memory in the access-evident packaging.

As used in this specification, the term "array of pharmaceuticals" is intended to be a broad term that encompasses any two- or three-dimensional arrangement or matrix of pharmaceuticals in a sheet or other carrier. An example of an "array of pharmaceuticals" is a blister sheet in which the pharmaceuticals are captured within plastic bubbles with a foil backing. The pharmaceuticals are often removed from the blister sheet by pressing them through the foil backing or peeling the foil backing away. The array may be arranged such that portions of a sheet fold onto other portions, with the pharmaceuticals of one portion nesting amongst those on the facing portion (as illustrated in FIGS. 25 and 26 of the next construction) to maximize the use of space.

The case 510 is generally rectangular, and includes a front panel 545, a rear panel 550, a side wall 555, a top wall 560, a bottom wall 565, and an open mouth 570 on the fourth side. The side wall 555, top wall 560, and bottom wall 565 can collectively be referred to as the "sides" of case 510. The side wall 555, top wall 560, and bottom wall 565 are formed integrally with the front panel 545, for example by injection molding.

The case 510 includes an inner cavity 575 (FIGS. 17 and 18) that is bounded by the panels 545, 550 and sides 555, 560, 565. The panels 545, 550 and sides 555, 560, 565 have inner surfaces that face the cavity 575 and outer surfaces that face away from the cavity 575.

Figure 13:
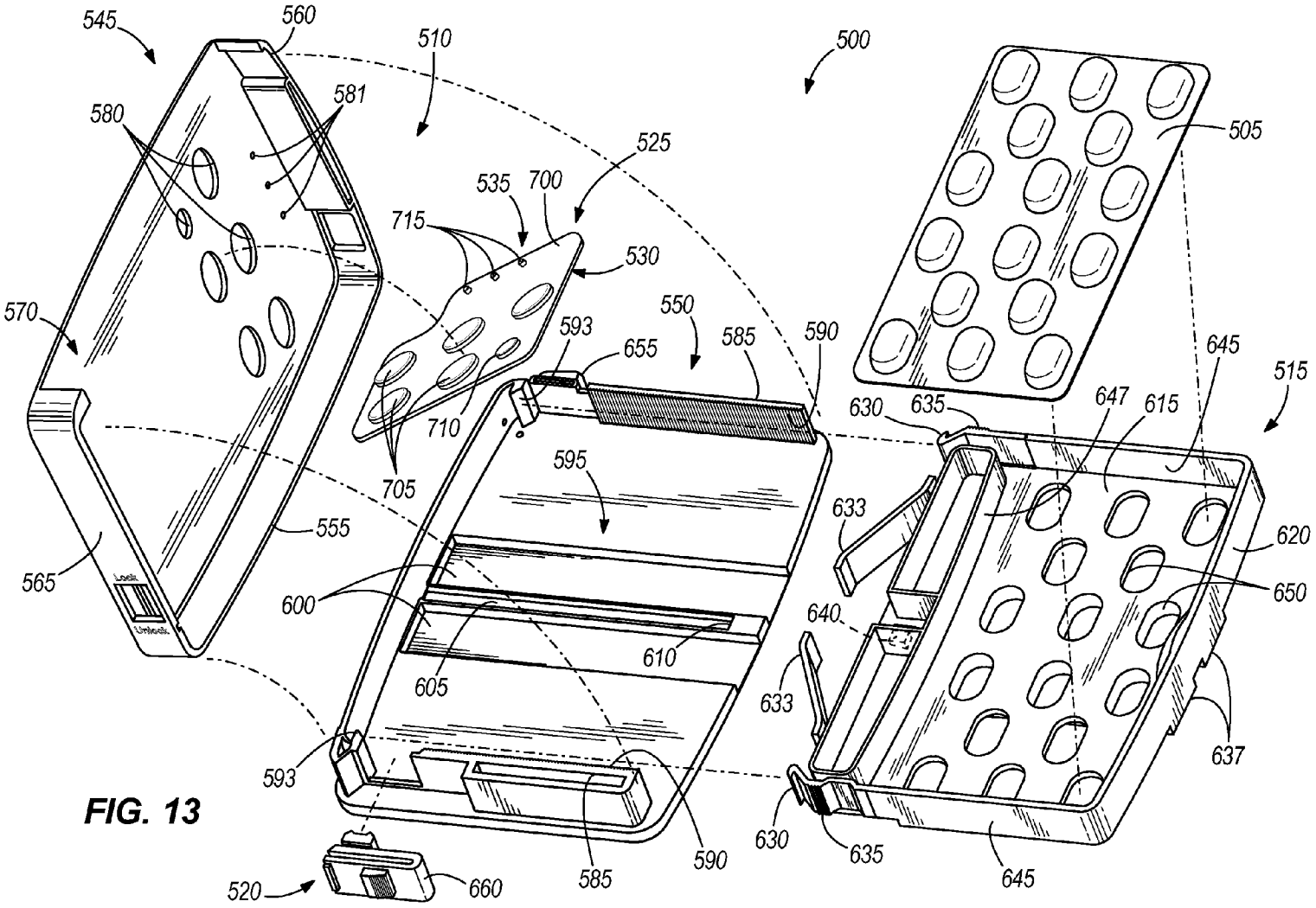
FIG. 13 is an exploded view of the construction of FIG. 11.
Figure 14:
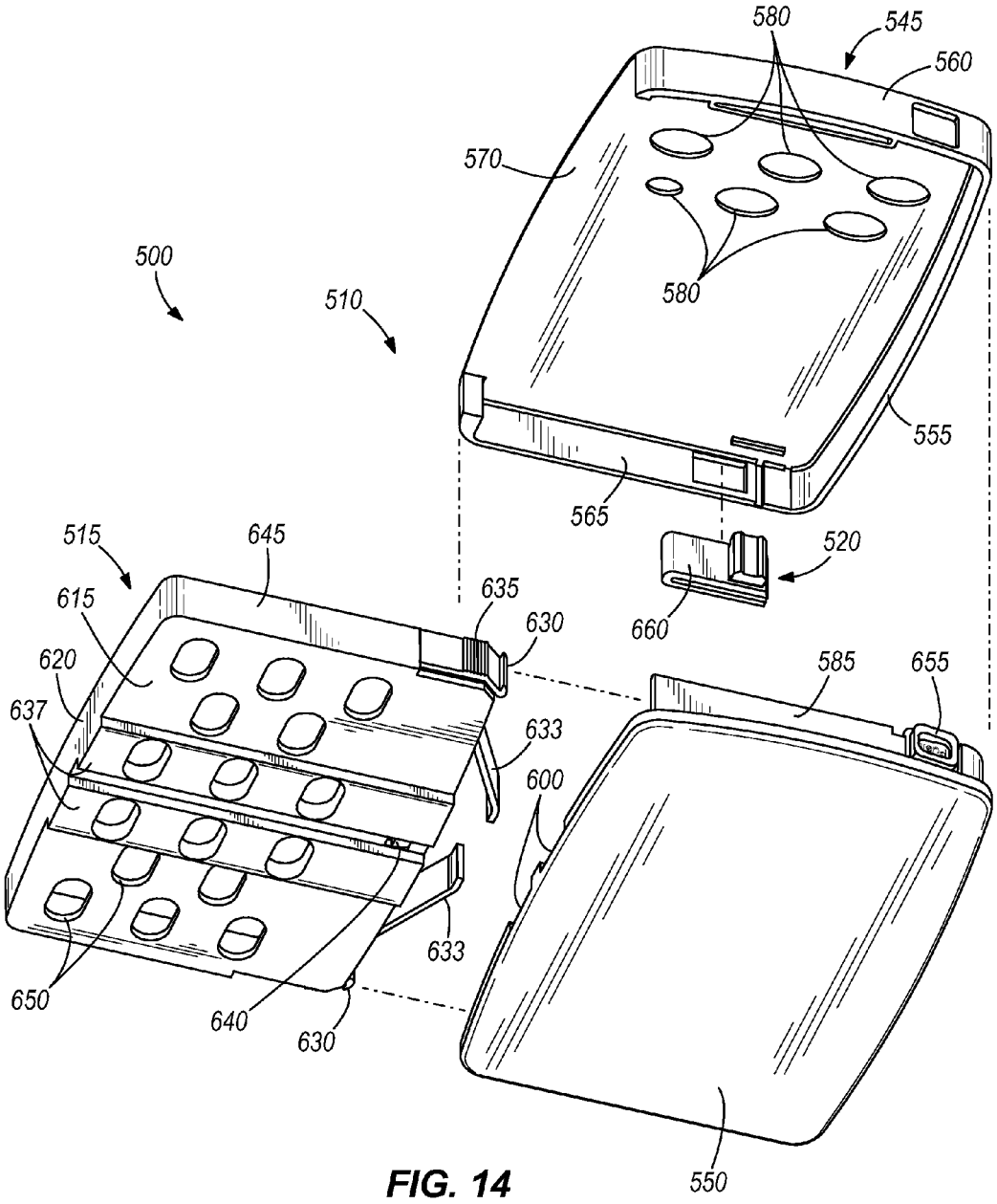
FIG. 14 is an exploded view of the case and tray of the construction of FIG. 11.

With reference to FIGS. 13 and 14, the front panel 545 includes a plurality of access apertures 580 for accommodating the user action 530 and apertures 581 for accommodating the access alert 535. The access apertures 580, 581 are preferably of the same shape as portions of the user action 530 and access alert 535, as will be discussed below.

The rear panel 550 includes side rails 585 with detent teeth 590 facing into the cavity 575, tray hooks 593 near the side wall 555, and an integrally-formed guide 595. All of these components of the rear panel 550 may be formed integrally as a single component, for example by injection molding. The guide 595 includes two outer channels 600 and a central channel 605. Each of the channels 600, 605 is bounded by parallel walls that extend generally from the side wall 555 to the mouth 570 of the case 510. The guide 595 also includes a stop surface 610 that extends across the central channel 605 a selected distance into the cavity 575 from the mouth 570. The stop surface 610 may be referred to as the end of the central channel 605. As will be discussed below, the child-resistant feature 520, detent teeth 590, and guide 595 interact with the tray 515.

In view of the above description and the drawings, the case 510 is essentially a two-piece, nesting arrangement.

The tray 515 includes a support panel 615, a face 620, a pair of tray latches 630, tray springs 633, detent followers 635, a pair of guide rails 637, a guide follower 640, side walls 645, and a back wall 647. Although discussed as separate elements, all of the components of the tray 515 may be integrally formed, for example in an injection molding process.

Figure 15:
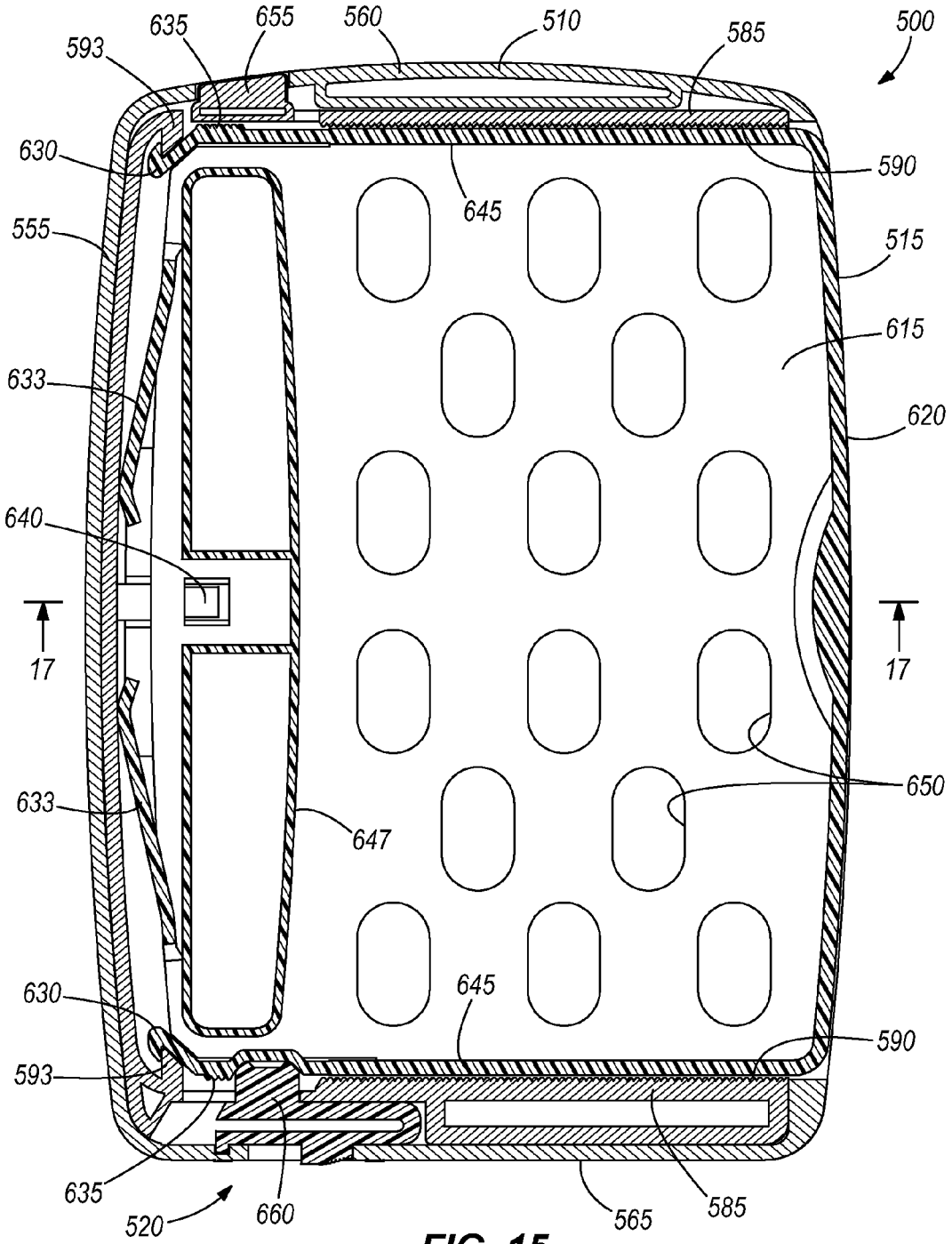
FIG. 15 is a cross-sectional view of the construction of FIG. 11.
Figure 16:
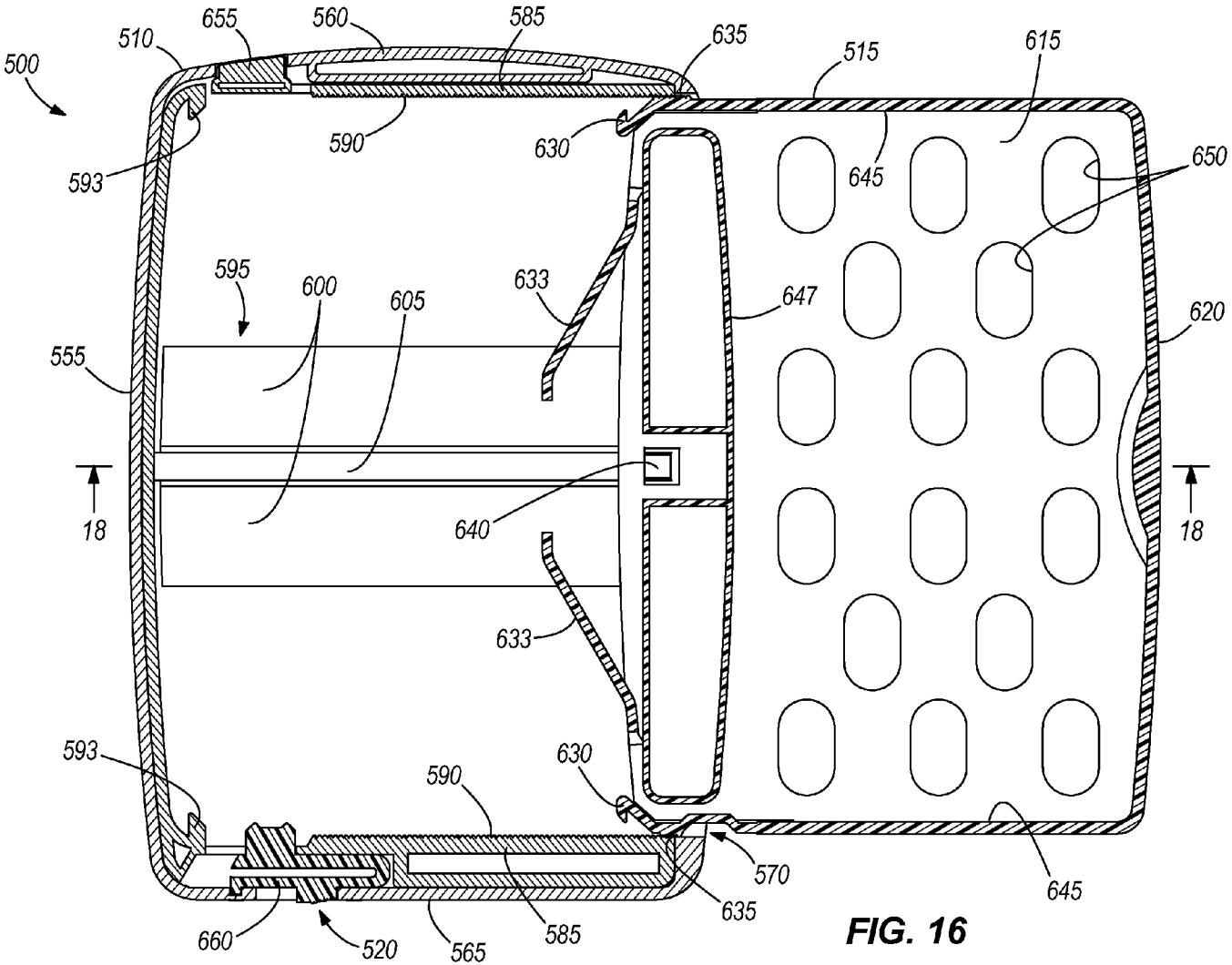
FIG. 16 is another cross-sectional view of the construction of FIG. 11.

The tray 515, which may also be called a drawer, is movable between open and closed positions. The closed position is when the tray 515 is received within the cavity 575 of the case 510 such that access cannot be had to the pharmaceutical sheet. In the illustrated construction (FIGS. 15 and 17), the tray 515 is closed when fully received within the cavity 575 with the face 620 covering the mouth 570 of the cavity. The open position is any position that is not the closed position. In this regard, even if the tray 515 is only slightly moved out of the closed position (i.e., slid only slightly out of the cavity 575), it is considered in the open position. The tray 515 is considered fully open when it reaches the end of its range of motion in a direction out of the cavity 575. The fully open position is illustrated in FIGS. 16 and 18. Because of the direction of sliding movement of the tray 515 into and out of the cavity 575, the portion of the cavity 575 adjacent the side 555 can be referred to as the back of the cavity 575, and the end of the tray 515 that sits in the back of the cavity 575 can be referred to as the back of the tray 515.

The side walls 645 border the support panel 615 on opposite sides, and the back wall 647 extends across the back of the tray 515. The array 505 is mounted to the support panel 615. In one arrangement, the array 505 may be heat staked or otherwise permanently or semi-permanently fixed to the support panel 615. The support panel 615 may include holes 650 in a pattern that matches the blister bubbles of the array 505, so that the pharmaceuticals can be pressed through the foil of the array 505 and through the holes 650 in the support panel 615. In other constructions, the array 505 may be inserted into the cavity 575 without the tray 515, or the tray 515 may be formed integrally with the array 505. The case 510 is adapted to receive the array 505, whether the array 505 is mounted on the tray 515 or the array 505 is formed essentially as its own tray.

Figure 11:
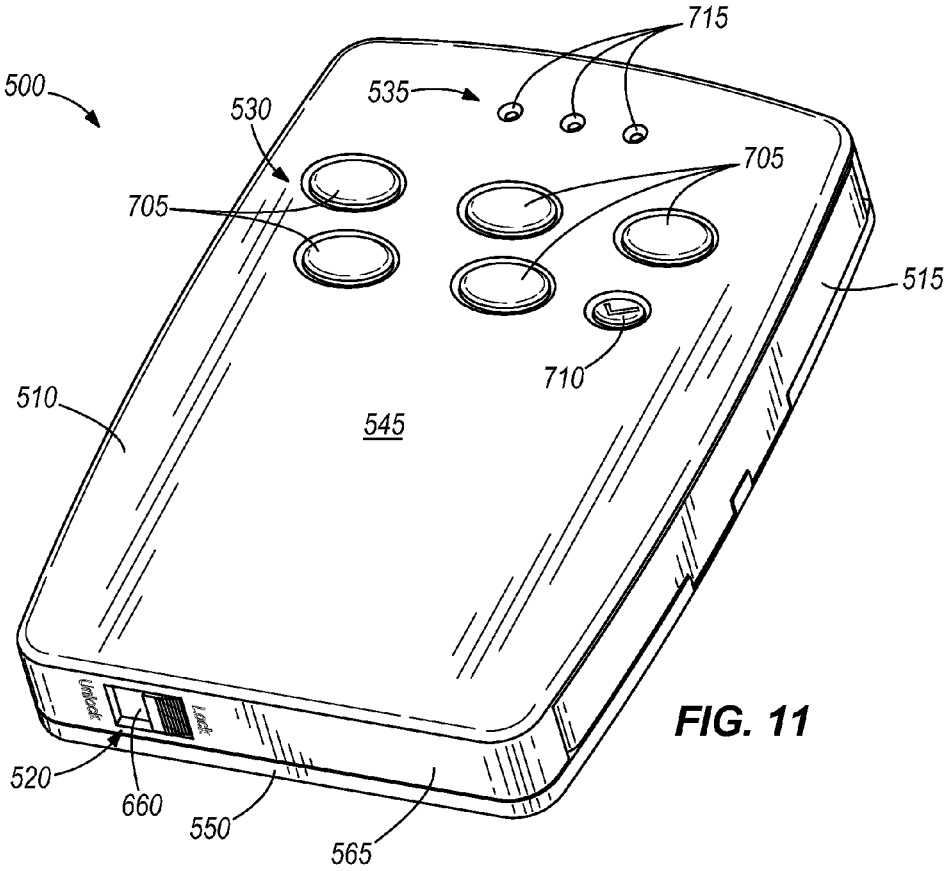
FIG. 11 is a perspective view of another construction of an access-evident packaging.
Figure 12:
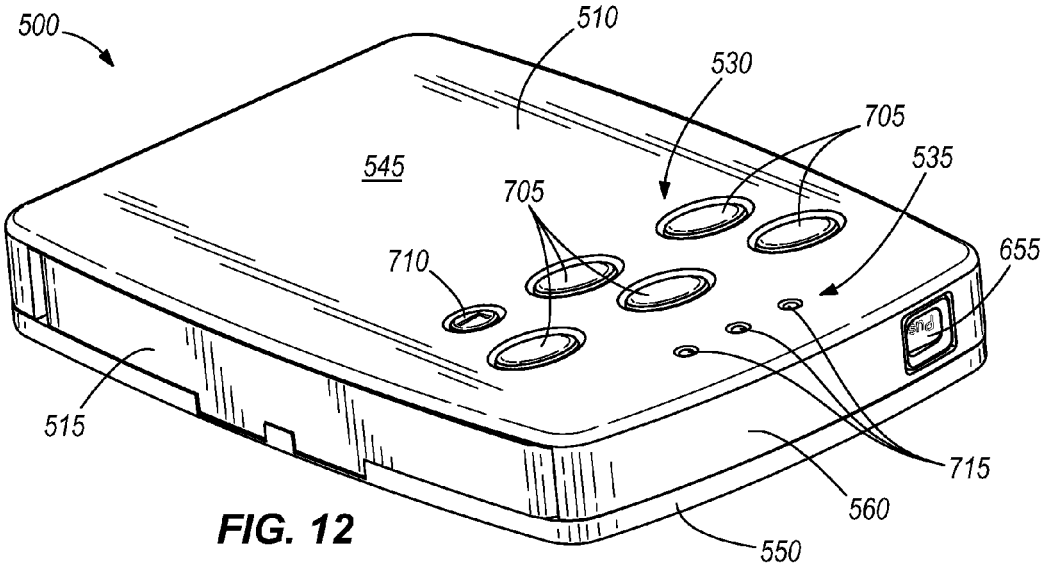
FIG. 12 is another perspective view of the construction of FIG. 11.

The tray face 620 is perpendicular to the support panel 615 and fills the mouth 570 of the cavity 575 when the tray 515 is closed (see, for example, FIGS. 11 and 12). The face 620 may include a user-graspable element, such as a knob or handle, to facilitate pulling the tray 515 out of the cavity 575 to expose the pharmaceuticals or may be smooth and flush as illustrated.

The tray latches 630 are integrally formed with the side walls 645 at the back of the tray 515. The tray latches 630 resiliently deflect inwardly, into the cavity 575, and spring back to the at-rest positions illustrated in FIG. 13. When the tray 515 is moved into the closed position (FIG. 15), the tray latches 630 deflect inwardly as they abut the tray hooks 593. Upon clearing the backside of the tray hooks 593, the tray latches 630 snap into engagement with the tray hooks 593 as illustrated in FIG. 15.

The tray springs 633 are mounted to a rear edge of the tray 515, and are in the form of leaf springs in the illustrated construction. In other constructions, the tray springs 633 may take the form of coil springs or any other suitable biasing elements. As the tray 515 is moved into the closed position, the tray springs 633 are deflected and a biasing force is generated. When the tray latches 630 are disengaged from the tray hooks 593 (by defeating the child-resistant feature 520, as will be discussed below), the biasing force in the tray springs 633 pops the tray 515 partially out of the cavity 575. Once the drawer is popped open, the user can grasp the tray face 620 to further open the tray 515. The package 500 may therefore be made with a smooth, flush side defined by the tray face 620 (as illustrated in FIGS. 11 and 12) because there is no need for a user-graspable element interrupting the smooth surface of the tray face 620.

The detent followers 635 are on the tray latches 630, and, as such, are part of the resilient portion of the side walls 645 at the back of the tray 515. The detent followers 635 include small teeth that engage the detent teeth 590 of the side rails 585 of the rear panel 550 of the case 510. As the tray 515 is pulled out of the cavity 575, the detent followers 635 engage the detent teeth 590 with a detent force arising from the spring-like action of the tray latches 630. When the force applied to the tray 515 exceeds a disengagement force (which overcomes the detent force), the detent followers 635 ride off the detent teeth 590 and deflect toward the center of the cavity 575 to clear the detent teeth 590. The detent followers 635 then snap out and engage the next detent teeth 590. The user experiences audible and tactile feedback (e.g., clicking) as the detent followers 635 engage and ride over the successive detent teeth 590.

Engagement of the detent teeth 590 with the detent followers 635 resists free-fall of the tray 515 out of the cavity 575 under the weight of the tray 515 when the package 500 is oriented with the mouth 570 down, and also assists the user in pulling the tray 515 out in a controlled manner rather than quickly or abruptly. In other constructions, the tray 515 and case 510 may have other types of engaging structures that engage each other to brake movement of the tray 515 with respect to the case 510 as the tray approaches a fully open position in which access is grated to the array of pharmaceuticals.

As illustrated in FIG. 14, the guide rails 637 extend the whole width of the bottom panel 615. The holes 650 in the panel 615 may extend through the guide rails 637, as illustrated. The guide rails 637 are received within the outer channels 600. The guide follower 640 comprises a flexible, resilient tongue that extends down from the bottom of the support panel 615 and is received in the central channel 605 of the guide 595. The interaction of the guide 595 with the guide rails 637 and guide follower 640 of the support panel 615 promotes smooth sliding action of the tray 515 and reduces the likelihood of pinching or binding between the tray 515 and the case 510.

Figure 17:
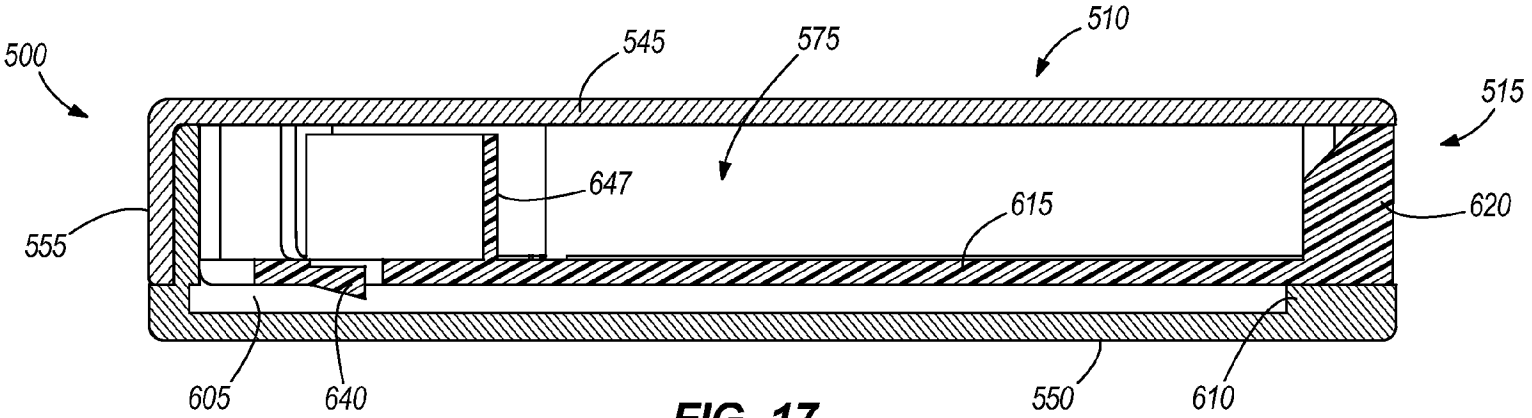
FIG. 17 is a cross-sectional view along line 17-17 in FIG. 15.
Figure 18:
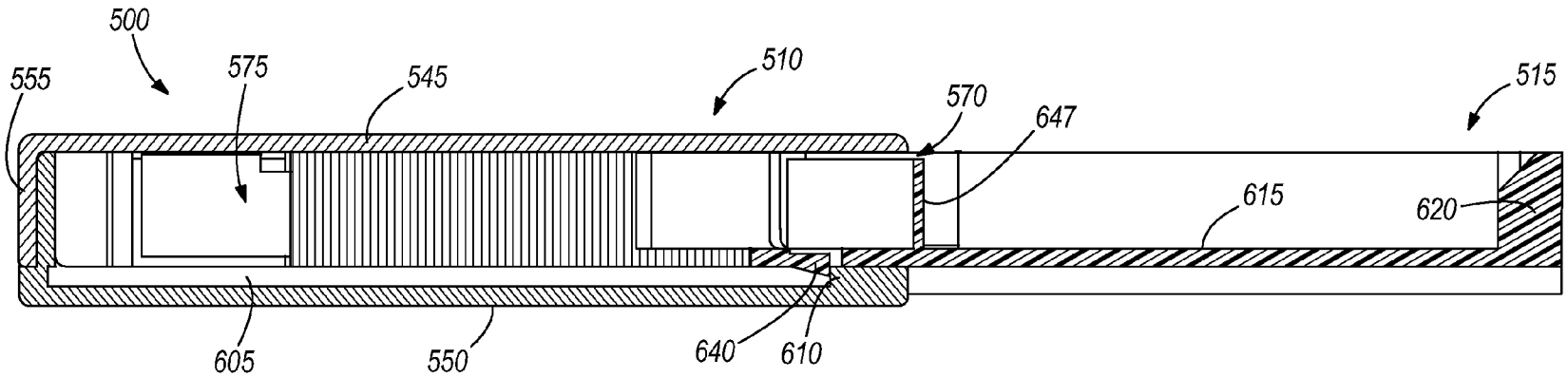
FIG. 18 is a cross-sectional view along line 18-18 in FIG. 16.

Referring now to FIGS. 17 and 18, during assembly, the tray 515 is slid into the cavity 575, with the guide rails 637 in the outer channels 600. The guide follower 640 deflects up as it abuts and rides over the stop surface 610. Once the tray 515 is inserted sufficiently far into the cavity 575 for the guide follower 640 to clear the stop surface 610, the guide follower 640 springs down into its at-rest position (illustrated in FIGS. 17 and 18), where it is received within the central channel 605. With particular reference to FIG. 18, the guide follower 640 abuts against the stop surface 610 of the guide 595 when the tray 515 has been pulled out of the cavity 575 a desired amount (e.g., when the tray 515 is sufficiently pulled out of the cavity 575 to enable the user to access the pharmaceuticals). The abutment of the guide follower 640 against the stop surface 610 resists complete removal of the tray 515 from the cavity 575, and reduces the likelihood of the tray 515 falling out of the cavity 575.

With reference to FIGS. 19-22, the child-resistant feature 520 feature includes a push button 655 and a slide lever 660. The push button 655 is integrally formed with a resilient, deflectable portion of the side rail 585 that is adjacent the top side 560 of the case 510, and the slide lever 660 is slidably mounted between the bottom side 565 and the adjacent side rail 585 of the case 510. Both the top and bottom sides 560, 565 of the case 510 include a window through which the push button 655 and slide lever 660 extend or can be accessed by a user's finger.

The slide lever 660 has a generally u-shaped section 670 and includes a cam portion 675, a positive latch 680, and a user actuation portion 685. The positive latch 680 is received in a groove 690 in the bottom side 565 of the case 510. The cam portion 675 includes a cupped top 695 and is received in a ramped portion 697 of the side wall 645 so that the tray latch 630 can engage the tray hook 593 (FIG. 19).

Figure 19:
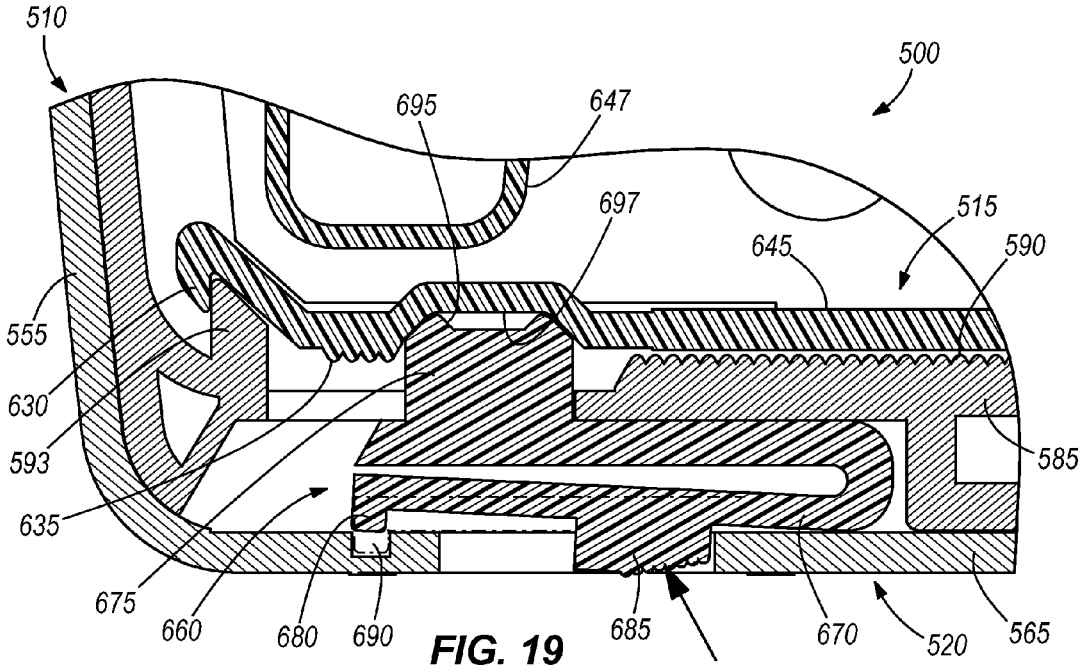
FIG. 19 is an enlarged view of a child-resistant feature of the construction of FIG. 11 in a first position.
Figure 20:
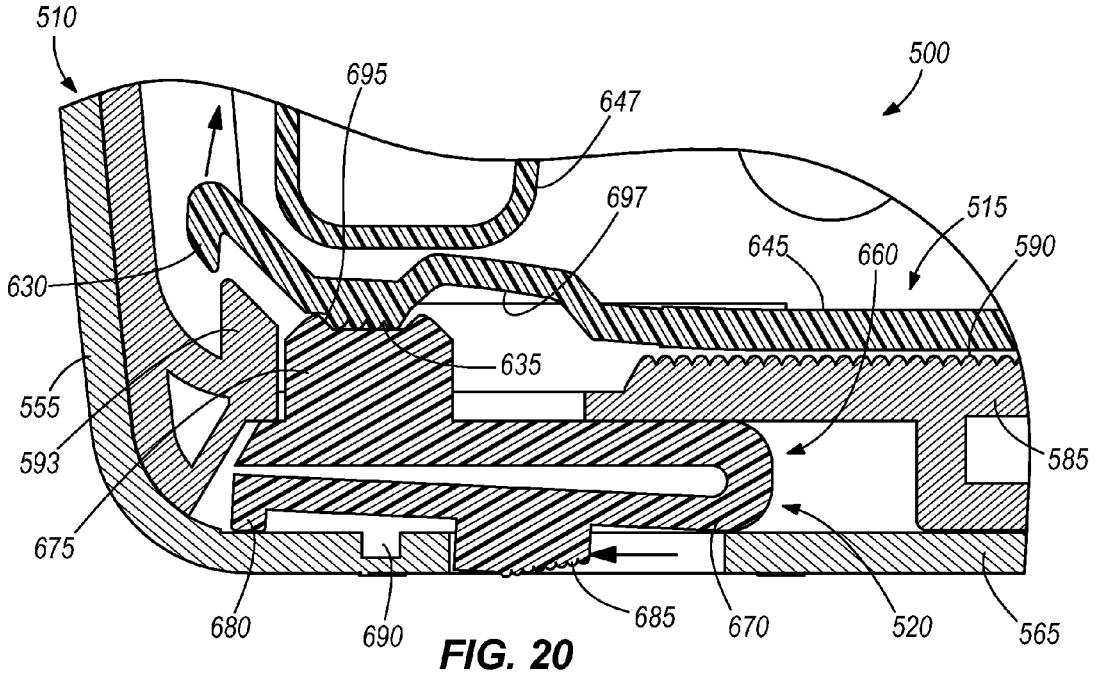
FIG. 20 is an enlarged view of the child-resistant feature in a second position.
Figure 22:
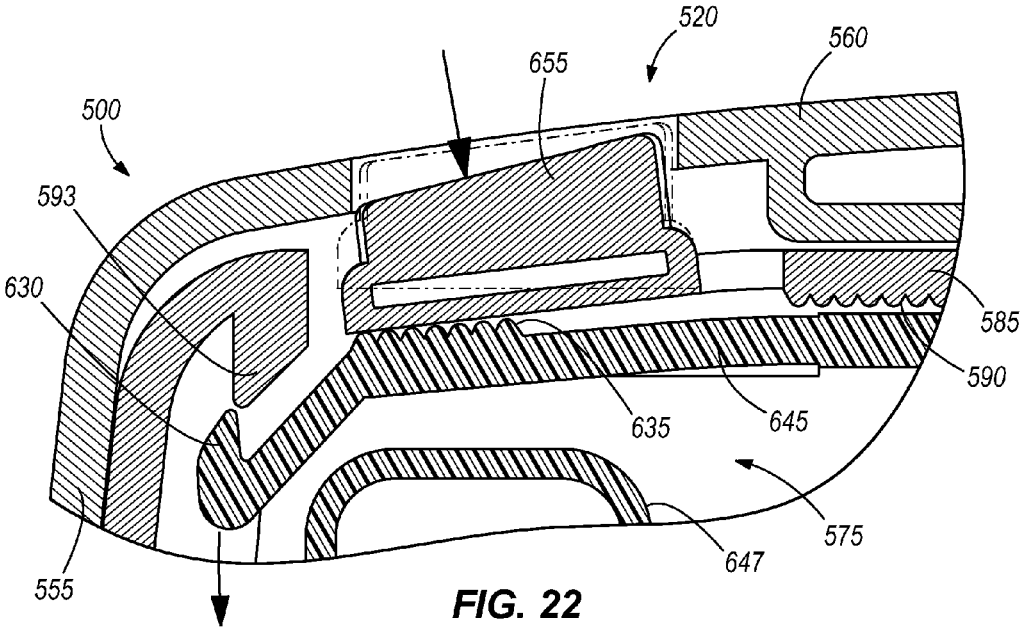
FIG. 22 is an enlarged view of another portion of the child-resistant feature.
Figure 23:
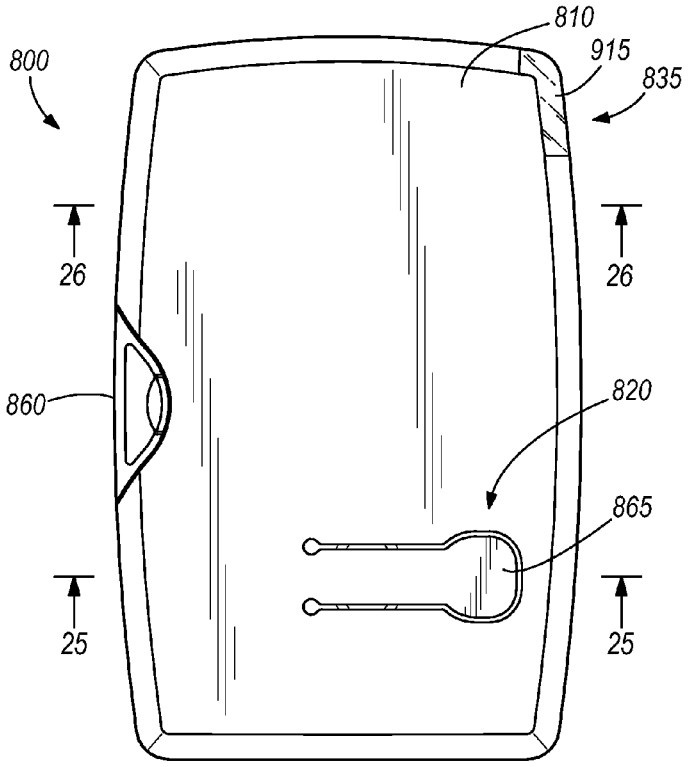
FIG. 23 is a side view of another construction of an access-evident packaging.
Figure 24:
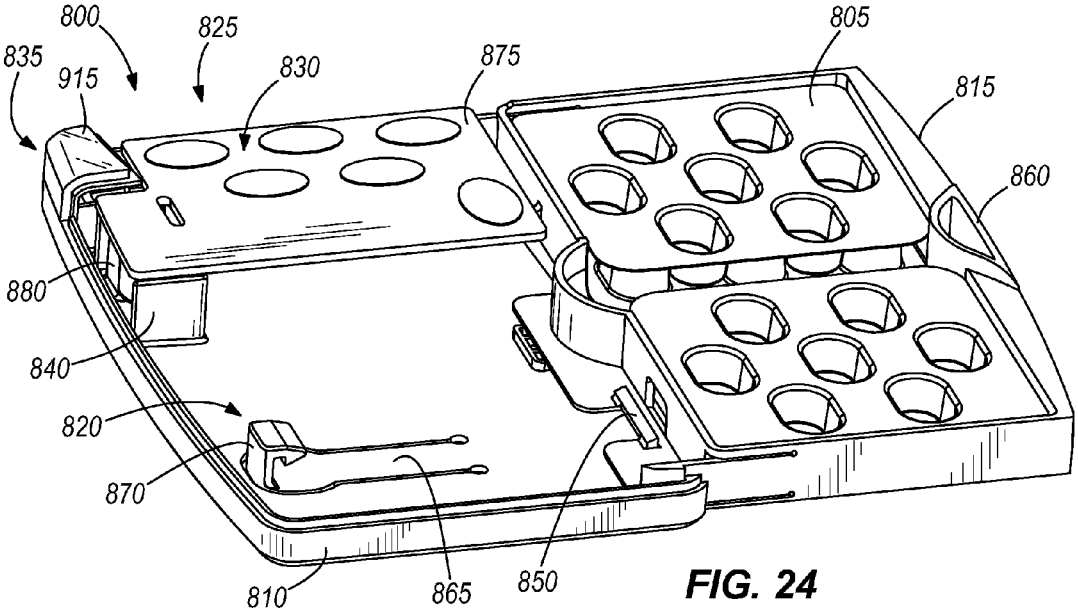
FIG. 24 is a perspective view of the construction of FIG. 23 in an open condition.

As seen in FIG. 19, a user presses on the user actuation portion 685 to deflect the u-shaped section 670 and lift the positive latch 680 out of the groove 690. As seen in FIG. 20, with continued pressure on the user actuation portion 685, the user slides the slide lever 660. As the slide lever 660 slides, the cam portion 675 engages the tray latch 630 and, owing to ramped surfaces on both the cam portion 675 and tray latch 630, lifts the tray latch 630 out of engagement with the tray hook 593. The cupped top 695 receives the detent followers 635. With reference to FIG. 22, a user presses the push button 655, which deflects the tray latch 630 adjacent the top wall 560. This disengages the tray latch 630 from the associated tray hook 593. To defeat the child-resistant feature 520, both tray latches 630 must be disengaged from the tray hooks 593. When this occurs, the springs 633 pop the tray 515 open, as described above.

Figure 21:
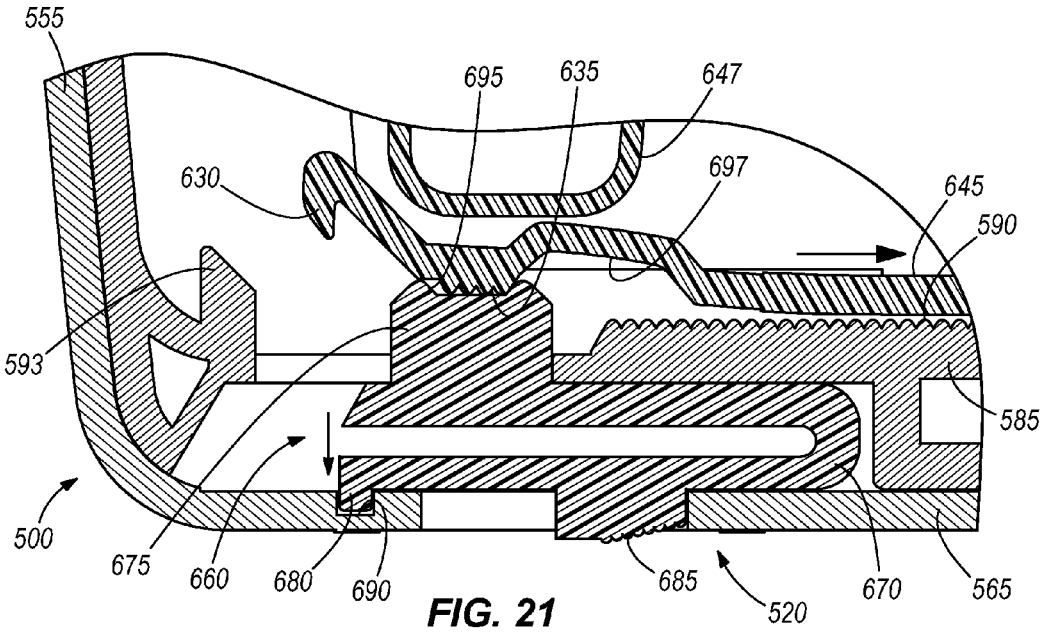
FIG. 21 is an enlarged view of the child-resistant feature in a third position.

As illustrated in FIG. 21, the slide lever 660 slides with the tray 515 because the detent followers 635 are received in the cupped top 695 of the cam portion 675. The deflected u-shaped portion 670 biases the positive latch 680 into the groove 690 when they are aligned. In this regard, the system automatically rests the slide lever 660 to the starting position. Further opening of the tray 515 pulls the detent followers 635 off the cupped top 695, and brings the detent followers 635 into engagement with the detent teeth 590 as discussed above. When the tray 515 is pushed back into the closed position, the tray latch 630 rides over the cam portion 675, which is held in place by engagement of the positive latch 680 and the groove 690. Both tray latches 630 engage the tray hook 593 when the tray 515 has reached the fully closed position.

Referring to FIGS. 11-13, the logic controller assembly 525 includes a circuit board 700 that carries a logic controller, a power source (e.g., a battery), the user action 530, an access status switch, and the access alert 535. The circuit board 700 is supported within the case 510 adjacent the front panel 545. The tray 515 slides in the space between the circuit board 700 and the rear panel 550. The circuit board 700 includes suitable circuity to electronically communicate the logic controller with the power source, user action 530, access alert switch, and access alert 535. The power source provides power to the logic controller and to any other power consuming components of the packaging.

The user action 530 is part of a user interface of the package 500. The term "user interface" means the interplay between a user and the system. The user interface is divided into two components: user actions and system responses. A user action is an input to the system from a user, for example pushing a button, actuating a latch or switch, or accessing the pharmaceuticals. A system response is an action taken by the system in response to a user action or other conditions. A system response might include a user feedback signal, such as a light, a blinking light, a vibration, or another indication that is detectable by a human. The system response may include a timer, for example, blinking a light for fifteen or twenty minutes following access to the pharmaceuticals.

In the illustrated construction, the user action 530 includes a keypad having a plurality of data entry keys 705, and a check key 710. In the illustrated construction, there are five data entry keys 705 and a single check key 710, but in other constructions, there may be more or fewer of each. The data entry keys 705 are oval in the illustrated construction and the check key 710 is circular, but these may be of different shapes in other constructions. The data entry keys 705 and the check key 710 fit with close tolerances within the access apertures 580.

The keys 705, 710 are mounted to the circuit board and electronically communicate with the logic processor. The keys 705, 710 are accessible by a user through the holes 580 in the front panel 545 of the case 510. The data entry keys 705 are used by the user to enter a security code. The data entry keys 705 may correspond to numbers, characters, icons, or any other unique sequence elements (generically, "characters") that the user can use to create the security code.

The access alert 535 in the illustrated construction includes three LEDs 715. In one example, the three LEDs 715 may be a green LED, an amber LED, and a red LED. These may be provided in other colors for different constructions. The logic controller provides user feedback through the access alert 535 during entry of the security code, and upon querying the state of the alarm. In other constructions, the access alert 535 may include vibration or sound generating elements. The three LEDs 715 fit with close tolerances within the access apertures 581.

The logic controller includes a memory and an alarm. The memory may be nonvolatile, so that it cannot be overwritten once programmed. The memory is designed to be programmed with a security code. The term "alarm" means a value stored in the logic controller memory. The alarm is a setting which includes three states: off (or "unset"), armed (or "set"), and triggered.

The access status switch electronically communicates with the logic controller through the circuits in the circuit board. A switch actuator of the tray engages the access status switch when the tray is closed. The switch actuator switches the access status switch from the first state to the second state, either by closing a circuit or physically shifting the access status switch depending on the type of access status switch employed. The access status switch is therefore in the first state in response to the array being in a fully closed position in the case and the second state in response to the array being at least partially removed from the case.

When the alarm is armed and the access status switch is in the first state, the logic controller switches the alarm to the triggered state in response to the access status switch being in the second state. The access status switch is normally in the second state, and can be embodied in a number types of switches. For example, the second state could be an open circuit state, in which case switching the access status switch to the second state could involve closing the circuit by introduction of a conductive element. In another example, the access status switch could be a toggle switch that is physically biased to the second state, in which case switching the access status switch to the second state could involve applying a physical force to move the toggle switch, wherein the toggle switch is biased back to the second state upon removal of the physical force.

Before the security code is programmed into memory, the alarm is not active and can therefore be said to be off. The logic controller generates a system response in response to a combination of a user action and the alarm setting. The system response may include illuminating the access alert 535 in a way that the user can interpret.

The logic of the controller is explained in detail below, but to summarize, the user programs a security code into the memory via the user action 530 and arms the alarm. In some constructions, the security code may come pre-programmed into memory. The logic controller changes the alarm from armed to triggered in response to the access status switch to notifying the logic controller that the tray 515 has moved out of the fully closed position. The user is able to check the status of the alarm by querying the logic controller through the user action 530. The logic controller communicates the status of the alarm to the user through the access alert 535. If the logic controller alerts the user that the alarm was triggered, the user knows that access has been attempted to the pharmaceuticals, at least to the extent of opening or partially opening the tray 515. If the alarm has been triggered, the user can reset the alarm to the armed state by entering the security code and pressing the check key 710 while the tray 215 is closed and the access status switch is in the first state.

The security code is a sequence of characters. One type of security code is a personal identification code or PIN. The security code can be of variable length. In the illustrated construction, the security code may be programmed as a string of 4, 5, or 6 characters. The check key 710 is pressed by the user to query the status of the alarm and during entry of the security code, as explained below in the logic flow charts.

FIGS. 23-27 illustrate another construction of an access-evident package 800 for an array of pharmaceuticals 805. This construction is similar in many respects to the package 500 described above, so it will suffice to point out the major components and then focus on the features of this construction that are different from what is disclosed above. Except as noted, all components, features, and functionality of the above-described constructions are included in this construction. Also, any components, features, and functionality of this construction can be incorporated into the previously-described constructions.

The package 800 includes a case 810, a tray 815, a child-resistant feature 820, a logic controller assembly 825, a user action 830, and an access alert 835. The rear panel of the case 810 includes a controller locating compartment 840. The controller locating compartment 840 interacts with the logic controller assembly 825 to locate the assembly within the cavity inside the case 810.

The tray 815 includes a switch actuator 845 (FIG. 26), a latch bar 850 (FIGS. 24 and 25), and a user-graspable element 860. The switch actuator 845 extends from the back of the tray 815 and engages a portion of the logic control assembly 825, as will be discussed in more detail below. The latch bar 850 is part of the child-resistant feature 820, as will be discussed in more detail below. The user-graspable element 860 facilitates pulling the tray out of the case 810 to expose the pharmaceuticals. There may be no need for springs to pop the tray 815 in view of the user-graspable element 860. As illustrated in FIGS. 25 and 26, the array 805 in this construction is folded onto itself with the pharmaceuticals of one portion nesting amongst those on the facing portion to maximize the use of space.

The child-resistant feature 820 includes a deflectable section 865, a child-resistant latch 870, and the latch bar 850. The deflectable section 865 is formed in the rear panel of the case 810, and bounded on three sides by a kerf. The deflectable section 865 is flush with the outer surface of the case 810. In some constructions, the deflectable section 865 can be covered with an adhesive label which may include instructions and warnings about use of the package 800 and the pharmaceuticals. The label may include a tactile locating element or features (e.g., a bump) to confirm to the user where to press to actuate the deflectable portion 865.

The child-resistant latch 870 is rigidly mounted to (and, in the illustrated construction, integrally formed with) the deflectable section 865 and extends into the case 810. When the tray 815 is closed, the child-resistant latch 870 engages the latch bar 850, and resists sliding movement of the tray 815 from the closed position. With reference to FIG. 25, when a user presses the deflectable section 865, the child-resistant latch 870 deflects inwardly, which disengages the child-resistant latch 870 by lifting the child-resistant latch 870 off the latch bar 850. With the child-resistant latch 870 disengaged, the user can slide the tray 815 out of the cavity.

The logic controller assembly 825 includes a circuit board 875, a logic controller 880, a power source 890, and an access status switch 895. The logic controller 880, power source 890, and access status switch 895 are mounted to the circuit board 875, as is the user action 830. The circuit board 875 includes circuitry to electronically communicate the logic controller 880 with the other elements on the circuit board 875 and the access alert 835. The circuit board 875 is supported along the inner face of the front panel of the case 810, and the tray 815 slides in the space between the circuit board 875 and the rear panel.

The logic controller 880 includes an internal memory and an alarm. The logic controller 880 is programmable with the logic sequences explained below. In one construction, the memory is nonvolatile. In one construction, a security code is programmed into the memory by the user through the user action, but in other constructions, the memory comes pre-programmed with the security code.

The access status switch 895 electronically communicates with the logic controller 880 through the circuits in the circuit board 875. The logic controller 880 sets the alarm to the armed state in response to the access status switch 895 being in the first state and switches the alarm to the triggered state in response to the access status switch 895 being in the second state.

With reference to FIG. 26, the switch actuator 845 of the tray 815 engages the access status switch 895 when the tray 815 is closed. The switch actuator 845 switches the access status switch 895 from the second state to the first state, either by closing a circuit or physically shifting the access status switch 895 depending on the type of access status switch employed. The access status switch 895 is therefore in the first state in response to the array 805 being in a fully closed position in the case 810 and the second state in response to the array 805 being at least partially removed from the case 810.

The access alert 835 includes an LED bank mounted in a corner of the case 810. The LED bank is covered with a lens 915. The LED bank includes a plurality of LEDs having different colors (e.g., green, red, and amber) to provided feed back to the user.

Figure 29A:
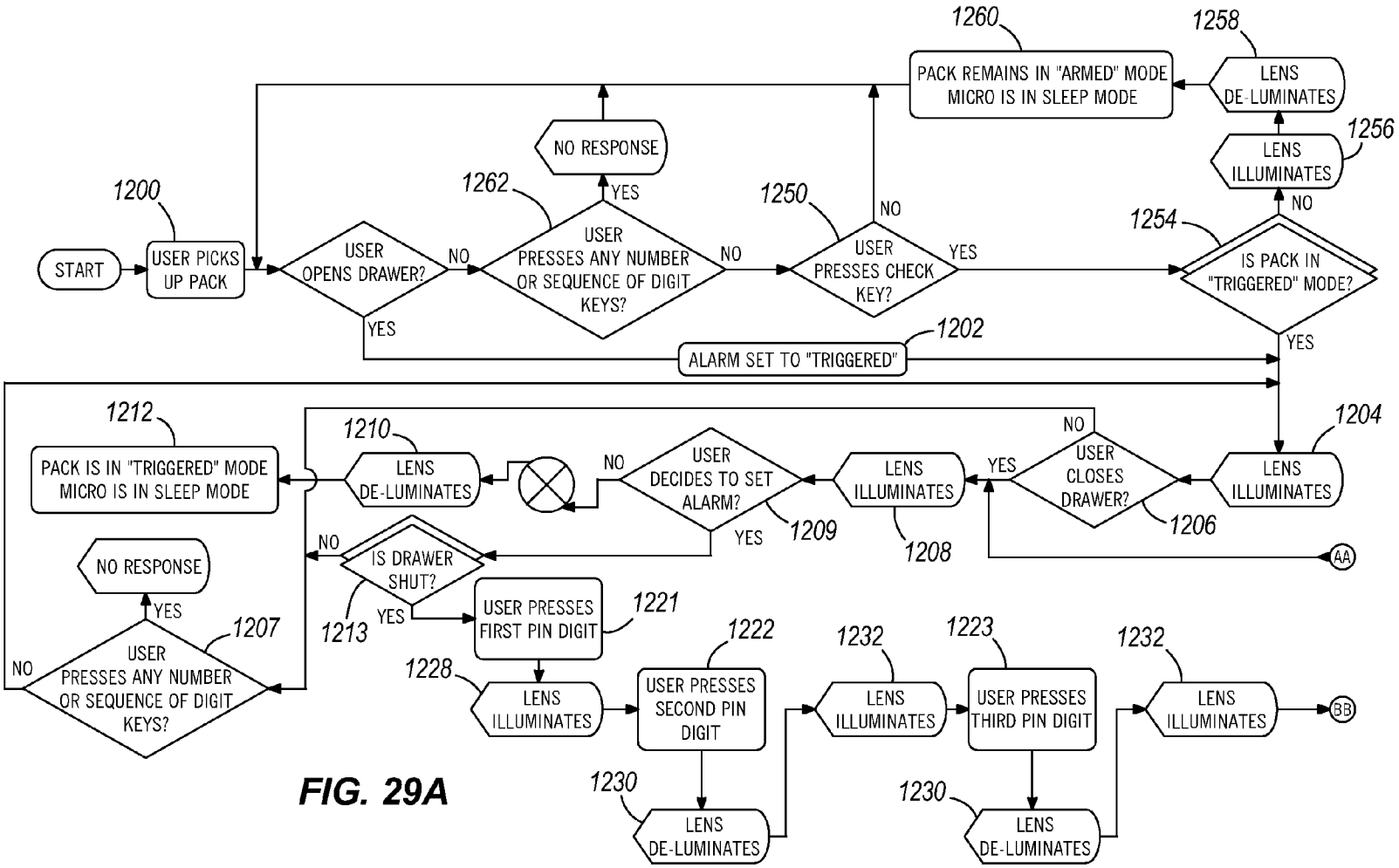
FIG. 29A is a first portion of another logic flow chart for arming and checking an alarm in the access evident packaging.
Figure 29B:
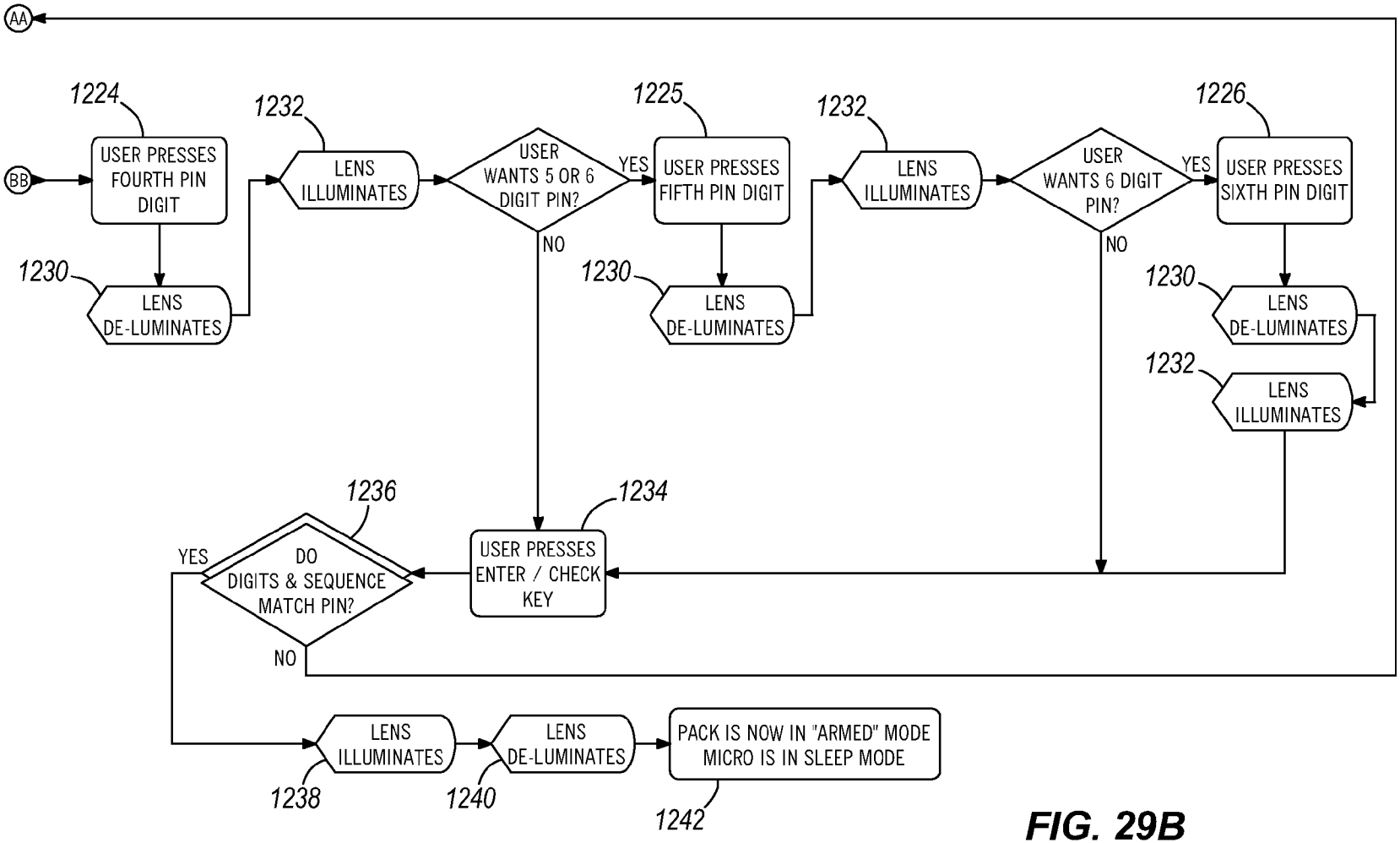
FIG. 29B is a second portion of another logic flow chart for arming and checking an alarm in the access evident packaging.

FIGS. 28 and 29 illustrate the logic flow or sequencing for the logic controller. Because of the large flow diagram, FIG. 28 is broken into FIGS. 28A, 28B, 28C, and 28 D. Likewise, FIG. 29 is broken into FIGS. 29A and 29B.

In the description that follows, illumination of the LEDs by the logic controller are considered providing user feedback signals. The user feedback signals are part of the system response. Although the illustrated user feedback signals in the examples provided are visual, in the form of LEDs, in other constructions the user feedback signals may include sound and/or vibrations that are detectable by the human user of the package, either in addition to the LEDs or in place of the LEDs.

FIG. 28 illustrates the control logic for activating the access-evident feature of the package, including programming a security code into the memory of the logic controller. The logic sequence starts at box 1100. In box 1102, the user opens the over pack in which the package is contained. In the illustrated arrangement, the alarm is initially unset or off. The end user of the product must program a security code into the memory to arm the alarm. The control logic of FIG. 28 governs this initial programming of the security code. In the illustrated example, once the security code is programmed into memory, the alarm will always be either armed or triggered; the alarm will never again be unset or off. In the description that follows, examples of how the LEDs might be illuminated are provided, but these examples are not intended to be limiting.

In box 1104, the package is revealed to the user, which provides access to the keypad area for security code entering and instructions for security code entering. A battery seal, which prevents the battery from draining while on the shelf, is also presented clearly to the user at this time. At decision point 1106, the user either removes the battery seal or does not. If the user does not remove the battery seal, the logic control stops and will not proceed due to an open carton error 1108. If the user decides to remove the battery seal, he or she does so at box 1110. Following this, the control logic blinks the red LED (e.g., 3 Hz for 3 seconds) at box 1112 to confirm that the battery seal has been removed. Then the control logic illuminates the red LED solid at box 1114.

The control logic then moves to decision point 1116, at which the user decides whether to enter the security code. If the user does not enter the security code, the logic moves to box 1118 at which a security code exception is identified and the logic returns to box 1114 (red LED solid illumination), where it awaits the user's input of the security code. If the user decides to enter the security code, the logic sequence moves to a security code entering portion in which the user enters a first, second, third, fourth, fifth, and sixth character with the keypad at boxes 1121, 1122, 1123, 1124, 1125, and 1126, respectively. In response to each character being entered, the control logic turns off the red LED for a short period (e.g., 0.25 second) at box 1128 and then illuminates the red LED solid at box 1130. In this example, the red LED is used during the initial security code entering process, the amber LED is used during the security code confirmation process (described below), and the green LED is used to confirm that the security code has been entered and confirmed and that the alarm is armed. If the user fails to enter the second or third characters (i.e., fails to proceed to box 1122 or 1123) within a defined time, the control logic goes to the security code exception box 1118, turns on the red LED at box 1114 and the security code entering portion of the logic begins again at 1116. The user may end the security code entering portion of the logic after the fourth, fifth, or sixth character has been entered (i.e., after boxes 1124, 1125, or 1126), at which time the logic goes to the security code confirming portion of the sequence at 1134 by pressing the check key at 1140.

In the security code confirming portion of the sequence, the logic controller first checks at decision point 1142 whether the security code contains the required number of characters (i.e., 4, 5, or 6 characters in the illustrated example). If the security code does not contain the required number of characters, the logic sequence alternates illuminating the amber and red LED's for a defined period (e.g., 2 Hz for 5 seconds) at box 1144, illuminates the red LED at box 1114, and returns to the security code entering portion at 1116. If the security code contains the required number of characters, the control logic blinks the amber LED (e.g., 3 Hz for 3 seconds) at box 1146 and then illuminates the amber LED solid at box 1148. As noted above, the amber LED is used during the security code confirmation process in this example. This is the only process in which the amber LED is used in the illustrated example. The user then proceeds to enter the security code characters at boxes 1151, 1152, 1153, 1154, 1155, and 1156. After each character is entered, the logic causes the amber LED to go off for a predetermined period (e.g., 0.25 seconds) at box 158 and then back on solid at box 160. After the security code has been reentered, the user presses the check key again at 1162 to end the security code confirmation process.

At 1164, the logic controller determines if the security code entered during the security code confirming portion matches the security code entered during the security code entering portion. If the security code matches, then the green LED is illuminated in the following sequence in the illustrated construction: 3 Hz for 3 seconds at 1166, followed by illuminating the green LED for 3 seconds at 1168, followed by turning off all LEDs at 1170. In some constructions, the security code is programmed into the memory in a nonvolatile state (i.e., security code cannot be overwritten in the memory). The logic controller then sets the alarm to "armed" and enters a sleep mode at 1172. Once the security code is successfully programmed, the alarm will always be in the armed or triggered mode; it will not again be in the unset or off mode.

FIG. 29 illustrates the control logic for checking the status of the alarm (i.e., armed or triggered) and rearming the alarm if it has been triggered. The logic sequence of FIG. 29 assumes that the security code has been programmed into memory, either through the logic sequence of FIG. 28 as described above, or because the security code comes preprogrammed in the memory. In this example, the logic controller will not enter the logic sequence of FIG. 29 if there is no security code in memory.

The process starts at box 1200 with the user (who may be one authorized or not authorized to have access), picking up the package. If the user opens the tray, the logic controller sets the alarm to triggered mode at 1202, and proceeds to box 1204 at which the red LED is illuminated. In some constructions, the logic controller may also be programmed to record in the memory the date and time at the alarm is set to triggered mode at 1202. Opening of the tray may, for example, be detected by the access status switch in response to the switch actuator being removed from contact with the switch. Opening of the tray may be deterred by a child-resistant feature, as discussed above, such that the tray cannot be opened unless the child-resistant feature is defeated.

In the illustrated example, the red LED blinks (e.g., 3 Hz for 3 seconds) at box 1204 in response to the tray being opened. If, at box 1206, the user does not close the tray, the logic goes through box 1207 and loops back to box 1204 while the tray is open. Box 1207 notes that the system provides no response and stays in the logic loop 1204-1206-1207 with the red LED blinking while the tray is open. The system will not recognize use of the keypad (even entering the correct security code and pressing the check key) while the tray is open. The logic controller may be programmed to stop blinking the red LED and go into sleep mode with the alarm triggered after a selected period in loop 1204-1206-1207 to prolong battery life.

When the tray is closed, the logic keeps the red LED illuminated with a different pattern for an extended period at box 1208. For example, in the illustrated construction, the red LED blinks on for 0.25 seconds at a 0.3 Hz frequency for 20 minutes. After the extended period, if the user does not decide to arm the alarm at 1209 (which may be because the user does not know the security code because the user is unauthorized), the red LED is turned off by the logic controller at box 1210, the alarm remains in trigger mode, and the logic controller enters sleep mode at 1212.

If the user decides to set the alarm at 1209, the logic controller will permit the user to do so at 1213 if the tray is closed. The user enters the security code characters through a user action (e.g., keypad) at 1221, 1222, 1223, 1224, 1225, and 1226. After the first character 1221, the red LED turns on solid at 1228. For each subsequent character, the red LED turns off for a brief time (e.g., 0.25 seconds) at 1230 and then is illuminated solid at 1232. Once the security code is entered, the user presses the check key at 1234. At box 1236, the logic controller compares the entered security code to the security code in memory, and if it does not match, the logic controller returns to box 1208 and illuminates the red LED. If the entered security code matches the security code in memory, the logic controller illuminates the green LED at 1238 for a sequence (e.g., 3 Hz for 3 seconds) and then turns all LEDs off at 1240. At 1242, the controller sets the alarm to "armed" and enters sleep mode.

With the alarm armed, the logic controller will receive a signal from the access status switch in the event the tray is at least partially slid out of the case. The logic controller automatically sets the alarm to a second status ("triggered") upon receiving such signal from the access status switch (i.e., in response to the logic controller sensing access to the pharmaceutical in the container).

The next time the user picks up the package at 1200, the alarm will remain in the state it was in. If the alarm is "armed," and the user presses the check key at 1250 before opening the tray, the logic controller will determine that the alarm is triggered at box 1254. If the alarm is not triggered (i.e., if it is armed), tray has not been opened since the alarm was last armed and the controller illuminates the green LED for a designated time and pattern (e.g., 2 Hz for 5 seconds) at 1256. The logic controller then shuts all LEDs off at 1258, keeps the alarm in "armed" mode at 1260, and returns to 1200. If the alarm is triggered (i.e., the tray has been opened since the last time the alarm was armed), the controller will make that determination at 1254 and enter the sequence described above, starting at 1204 (red LED blinking at 3 Hz for 3 seconds). The logic will ignore and provide no response to the user entering any sequence of characters at 1262, before the user presses the check key 1250.

In view of the above logic, the system provides a green light to indicate no access if the user presses the check key while the tray is closed and the alarm is armed. The system provides no response when the alarm is armed and a user presses any of the keypad keys other than the check key.

The system will switch the alarm to triggered whenever the tray is opened with the alarm in the armed state. This is true whether the user presses the check key prior to opening the tray, or simply opens the tray without pressing the check key. In the illustrated examples, there is no way to preempt the alarm going to triggered mode upon opening of the tray (e.g., by entering the security code prior to opening the tray). The alarm will always be triggered when the drawer is opened.

The only way to change the alarm status from triggered to armed is to close the tray, enter the security code, and press the check key. The alarm cannot be changed from triggered to armed while the tray is open.

It should be understood from the foregoing that, while particular constructions of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A tamper-evident package for pharmaceuticals, comprising:

a case, comprising a key pad and one or more indicator lights; and a tray, wherein the tray is engaged to the case;

wherein the tray holds a blister sheet of pharmaceutical tablets;

wherein the case substantially conceals or encloses the blister sheet within the case when the tray is closed; and wherein the case comprises a logic controller in electrical communication with the indicator lights and the key pad, wherein the key pad comprises a status key to check, wherein the logic controller includes an alarm switchable between an armed state and a triggered state, wherein the logic controller flashes a first color indicator light in response to actuating the status key when the alarm is in the armed state and the logic controller flashes a second color indicator light in response to actuating the status key when the alarm is in the triggered state.

2. The tamper-evident package for pharmaceuticals according to claim 1, wherein the blister sheet includes a first side and a second side, wherein the first side folds over on to the second side, and the tablets of the first side and the tablets of the second side are in an interweaving arrangement.

3. The tamper-evident package for pharmaceuticals according to claim 1, wherein the case comprises a logic controller in electrical communication with the indicator lights and the key pad, wherein the tray slides in and out of a side opening of the case, and triggers a switch of the logic controller.

4. A tamper-evident package for pharmaceuticals comprising:

a case, comprising a key pad and one or more indicator lights; and a tray, wherein the tray is engaged to the case;

wherein the case comprises a logic controller in electrical communication with the indicator lights and the key pad, wherein the key pad comprises a status key to check whether the tamper-evident package has been accessed without entering a security code.

5. An access-evident package for an array of pharmaceuticals, the package comprising:

a case adapted to receive the array in a closed position at least partially within the case, the array being movable into an open position for access to the pharmaceuticals;

a logic controller mounted to the case, the logic controller including memory to receive and store a security code and also including an alarm having an armed state and a triggered state; and a user action electronically communicating with the logic controller and enabling a user to enter the security code to cause the logic controller to set the alarm to the armed state;

wherein the logic controller switches the alarm to the triggered state in response to the array moving from the closed position to the open position.

6. The access evident package of claim 5, wherein the user action includes a keypad for entering the security code.

7. The access evident package of claim 5, wherein the logic controller prevents entry of the security code while the array is at least partially removed from the case.

8. The access evident package of claim 5, further comprising an access alert electronically communicating with the logic controller; wherein the logic controller activates the access alert in response to the alarm being in the triggered state.

9. The access evident package of claim 5, further comprising an access alert electronically communicating with the logic controller; wherein the user action includes a check key; and wherein the logic controller activates the access alert in response to the alarm being in the triggered state and a user actuating the check key.

10. The access-evident package of claim 5, further comprising a latch preventing movement of the array from the fully closed position; and a slide lever movable into a disengaging position in which the slide lever disengages the latch to permit movement of the array from the closed position.

11. The access-evident package of claim 10, wherein the slide lever is moved out of the disengaging position in response to moving the array into the fully closed position.

12. The access-evident package of claim 5, further comprising a tray adapted to carry the array, the tray being received within the case and adapted to slide at least partially in and out of the case to provide access the array.

13. The access evident package of claim 12, further comprising engaging structures on each of the case and tray that engage each other to brake movement of the tray with respect to the case as the tray approaches a fully open position in which access is grated to the array of pharmaceuticals.

14. The access evident package of claim 5, further comprising a biasing member acting on the array; wherein the biasing member is deflected upon movement of the array into the fully closed position, to generate a biasing force in the biasing member; wherein the biasing force biases the array toward an open position in which at least a portion of the array is removed from the case.

15. The access evident package of claim 14, further comprising a child-resistant mechanism holding the array in the fully closed position against the biasing force; wherein actuation of the child-resistant mechanism releases the array to enable the biasing member to move the array toward the open position under the influence of the biasing force.

* * * * *